US005983429A

United States Patent [19]

Stacy et al.

[11] Patent Number: 5,983,429

[45] Date of Patent: Nov. 16, 1999

[54] METHOD AND APPARATUS FOR SUPPORTING AND FOR SUPPLYING THERAPY TO A PATIENT

[76] Inventors: Richard B. Stacy, 944 Stonecrab Ct.; Craig D. Ellis, 224 Riverland Dr., both of Charleston, S.C. 29412; Barry D. Hand, 808 Milldenhall Rd.; James M. C. Thomas, 1486 Greenshade Way, both of Mt. Pleasant, S.C. 29464; Kenith W. Chambers, 7504 Rock St., Charleston, S.C. 29418; Stephen E. Glover, 1231 Silverleaf Cir., Charleston, S.C. 29412; Richard I. Barnett, 1349 Topsail Ct.; Paul B. King, 1565 Landings Run, both of Mount Pleasant, S.C. 29464; Ryszard S. Ozarowski, 169 Bridgestone Dr., Marietta, Ga. 30066; William T. Sutton, 2314 Furman Dr., Charleston, S.C. 29414

[21] Appl. No.: 09/160,963

[22] Filed: Sep. 23, 1998

Related U.S. Application Data

[63] Continuation of application No. 08/780,050, Dec. 23, 1996, which is a continuation of application No. 08/196,047, Feb. 15, 1994, Pat. No. 5,586,346.

[51] Int. Cl.[6] ..... A61G 7/057

[52] U.S. Cl. ..... 5/713; 5/915; 5/715; 5/710

[58] Field of Search ..... 5/615, 915, 710, 5/711, 712, 713, 714, 715, 911

[56] References Cited

U.S. PATENT DOCUMENTS

| | | | |
|---|---|---|---|
| 624,638 | 5/1899 | Fournier . | |
| 1,147,560 | 7/1915 | Shurtleff . | |
| 1,468,072 | 9/1923 | Ogle . | |
| 1,772,310 | 8/1930 | Hart . | |
| 2,245,909 | 6/1941 | Enfiajian | 5/348 |

(List continued on next page.)

FOREIGN PATENT DOCUMENTS

| | | | |
|---|---|---|---|
| 401767 | 3/1967 | Australia . | |
| 0 162 785 | 11/1958 | European Pat. Off. | A61G 7/10 |
| 0 034 954 | 9/1981 | European Pat. Off. | A47C 27/10 |
| 0 122 666 | 10/1984 | European Pat. Off. | A61G 7/04 |
| 0 134 051 | 3/1985 | European Pat. Off. | A47C 27/08 |
| 0 168 213 | 1/1986 | European Pat. Off. | A61G 7/04 |
| 0 228 233 | 7/1987 | European Pat. Off. | A61G 7/04 |
| 0 261 830 | 3/1988 | European Pat. Off. | A61G 7/04 |
| 0 275 618 | 7/1988 | European Pat. Off. | A61G 7/04 |
| 0 296 689 | 12/1988 | European Pat. Off. | A47C 27/10 |
| 0 302 579 | 2/1989 | European Pat. Off. | A61G 7/04 |
| 0 311 993 | 4/1989 | European Pat. Off. | A61G 7/04 |
| 0 338 472 | 10/1989 | European Pat. Off. | A61G 7/04 |
| 2249013 | 7/1974 | Germany | A61G 7/04 |
| 7522889 | 11/1975 | Germany | A47C 27/08 |
| 2446935 | 4/1976 | Germany | A47G 9/00 |
| 7334397 | 9/1976 | Germany | A47C 27/10 |
| 2522863 | 11/1976 | Germany | A61B 7/00 |

(List continued on next page.)

OTHER PUBLICATIONS

Advertisement, "Alphabed Alternating Pressure Pads & Pumps"; from Hospital Equipment and Supplies; (undated).
Advertisement, TASSI MK2; (undated).

(List continued on next page.)

*Primary Examiner*—Michael F. Trettel

[57] ABSTRACT

An apparatus is provided which supports a patient on an inflatable structure. The inflatable structure preferably has two components: a) lower inflatable layer which is selectively operable to provide basic support for the patient and which includes a plurality of laterally offset zone which may be independently inflatable to control rotation of the patient. Further, a second inflatable layer includes a plurality of zones for establishing optimal patient interface pressures and patient comfort levels, and may also include sufficiently independent inner chambers to facilitate the providing of specific therapies such as alternation of primary pressure contact areas, or percussion or vibration of the patient through inner cell inflation.

5 Claims, 34 Drawing Sheets

U.S. PATENT DOCUMENTS

| | | | |
|---|---|---|---|
| 2,415,150 | 2/1947 | Stein | 5/348 |
| 2,437,006 | 3/1948 | Simpson | 128/33 |
| 2,460,245 | 1/1949 | Summerville | 128/33 |
| 2,491,557 | 2/1949 | Goolsbee | 5/348 |
| 2,575,764 | 11/1951 | Morner | 154/85 |
| 2,604,641 | 7/1952 | Reed | 5/349 |
| 2,719,986 | 10/1955 | Rand | 5/348 |
| 2,998,817 | 9/1961 | Armstrong | 128/33 |
| 3,148,391 | 9/1964 | Whitney | 5/348 |
| 3,192,540 | 7/1965 | Swank | 5/349 |
| 3,199,124 | 8/1965 | Grant | 5/349 |
| 3,297,023 | 1/1967 | Foley | 128/33 |
| 3,303,518 | 2/1967 | Ingram | 5/349 |
| 3,317,934 | 5/1967 | Hinrichs | 5/349 |
| 3,363,941 | 1/1968 | Wierwille | 297/284 |
| 3,390,674 | 7/1968 | Jones | 128/33 |
| 3,394,415 | 7/1968 | Parker | 5/348 |
| 3,421,163 | 1/1969 | Stoughton | 5/348 |
| 3,426,373 | 2/1969 | Scott et al. | 5/348 |
| 3,446,203 | 5/1969 | Murray | 128/24.2 |
| 3,462,778 | 8/1969 | Whitney | 5/347 |
| 3,467,081 | 9/1969 | Glass | 128/33 |
| 3,477,071 | 11/1969 | Emerson | 5/61 |
| 3,485,240 | 12/1969 | Fountain | 128/33 |
| 3,492,988 | 2/1970 | DeMare | 128/33 |
| 3,587,568 | 6/1971 | Thomas | 128/33 |
| 3,595,223 | 7/1971 | Castagna | 128/33 |
| 3,605,138 | 9/1971 | Tucker | 5/90 |
| 3,605,145 | 9/1971 | Graebe | 5/348 |
| 3,644,950 | 2/1972 | Lindsay, Jr. | 5/347 |
| 3,653,083 | 4/1972 | Lapidus | 5/348 |
| 3,667,073 | 6/1972 | Renfroe | 5/81 |
| 3,670,347 | 6/1972 | Weinstein | 5/348 |
| 3,674,019 | 7/1972 | Grant | 128/33 |
| 3,678,520 | 7/1972 | Evans | 5/91 |
| 3,701,173 | 10/1972 | Whitney | 5/349 |
| 3,740,777 | 6/1973 | Dee | 5/348 |
| 3,757,356 | 9/1973 | Freeman | 4/112 |
| 3,762,404 | 10/1973 | Sakita . | |
| 3,775,781 | 12/1973 | Bruno et al. | 5/61 |
| 3,784,994 | 1/1974 | Kery | 5/348 |
| 3,795,021 | 3/1974 | Moniot | 5/341 |
| 3,822,425 | 7/1974 | Scales | 5/348 R |
| 3,867,732 | 2/1975 | Morrell | 5/349 |
| 3,870,450 | 3/1975 | Graebe | 425/269 |
| 3,879,776 | 4/1975 | Solen | 5/350 |
| 3,909,858 | 10/1975 | Ducker | 5/348 R |
| 3,919,730 | 11/1975 | Regan | 5/348 R |
| 3,935,604 | 2/1976 | Collins | 5/90 |
| 3,949,438 | 4/1976 | Scales | 5/348 R |
| 3,955,563 | 5/1976 | Maione | 128/53 |
| 3,978,530 | 9/1976 | Amarantos | 5/68 |
| 3,982,786 | 9/1976 | Burgin et al. | 297/284 |
| 4,005,236 | 1/1977 | Graebe | 428/72 |
| 4,068,334 | 1/1978 | Randall | 5/365 |
| 4,094,025 | 6/1978 | Nystad | 5/365 |
| 4,099,276 | 7/1978 | Hunt et al. | 5/72 |
| 4,132,228 | 1/1979 | Green | 128/33 |
| 4,136,413 | 1/1979 | Scales | 5/365 |
| 4,149,285 | 4/1979 | Stanton | 5/347 |
| 4,175,297 | 11/1979 | Robbins et al. | 5/284 |
| 4,185,341 | 1/1980 | Scales | 5/461 |
| 4,190,286 | 2/1980 | Bentley | 297/284 |
| 4,193,149 | 3/1980 | Welch | 5/447 |
| 4,197,837 | 4/1980 | Tringali et al. | 128/33 |
| 4,225,989 | 10/1980 | Corbett et al. | 5/453 |
| 4,267,611 | 5/1981 | Agulnick | 5/453 |
| 4,279,044 | 7/1981 | Douglas | 5/453 |
| 4,280,487 | 7/1981 | Jackson | 128/33 |
| 4,347,633 | 9/1982 | Gamoons et al. | 4/453 |
| 4,391,009 | 7/1983 | Schild et al. | 5/453 |
| 4,422,194 | 12/1983 | Viesturs et al. | 5/451 |
| 4,428,087 | 1/1984 | Horn | 5/449 |
| 4,454,615 | 6/1984 | Whitney | 5/449 |
| 4,472,847 | 9/1984 | Gammons et al. | 5/453 |
| 4,483,030 | 11/1984 | Flick et al. | 5/458 |
| 4,488,322 | 12/1984 | Hunt et al. | 5/453 |
| 4,508,107 | 4/1985 | Strom et al. | 128/54 |
| 4,517,693 | 5/1985 | Viesturs | 5/451 |
| 4,525,885 | 7/1985 | Hunt et al. | 5/453 |
| 4,525,886 | 7/1985 | Savenije | 5/464 |
| 4,527,298 | 7/1985 | Moulton | 5/66 |
| 4,528,704 | 7/1985 | Wegener et al. | 5/81 |
| 4,534,078 | 8/1985 | Viesturs et al. | 5/452 |
| 4,541,136 | 9/1985 | Graebe | 5/456 |
| 4,542,547 | 9/1985 | Sato | 5/453 |
| 4,551,874 | 11/1985 | Matsumura et al. | 5/453 |
| 4,583,255 | 4/1986 | Mogaki et al. | 5/453 |
| 4,594,743 | 6/1986 | Owen et al. | 5/111 |
| 4,614,000 | 9/1986 | Mayer | 5/484 |
| 4,617,690 | 10/1986 | Grebe | 5/453 |
| 4,622,706 | 11/1986 | Takeuchi | 5/453 |
| 4,638,516 | 1/1987 | Vrzalik | 5/64 |
| 4,638,519 | 1/1987 | Hess | 5/455 |
| 4,642,825 | 2/1987 | Kurita | 5/453 |
| 4,653,130 | 3/1987 | Senoue et al. | 5/453 |
| 4,654,903 | 4/1987 | Chubb et al. | 5/61 |
| 4,662,012 | 5/1987 | Torbet | 5/453 |
| 4,686,719 | 8/1987 | Johnson et al. | 5/81 |
| 4,686,722 | 8/1987 | Swart | 5/453 |
| 4,688,283 | 8/1987 | Jacobson et al. | 5/449 |
| 4,694,520 | 9/1987 | Paul et al. | 5/453 |
| 4,697,290 | 10/1987 | Alklind et al. | 5/61 |
| 4,698,864 | 10/1987 | Graebe | 5/441 |
| 4,700,418 | 10/1987 | Ritter | 5/449 |
| 4,711,275 | 12/1987 | Ford et al. | 141/95 |
| 4,722,105 | 2/1988 | Douglas | 5/453 |
| 4,729,598 | 3/1988 | Hess | 297/180 |
| 4,745,647 | 5/1988 | Goodwin | 5/453 |
| 4,768,249 | 9/1988 | Goodwin | 5/453 |
| 4,797,962 | 1/1989 | Goode | 5/453 |
| 4,798,227 | 1/1989 | Goodwin | 137/554 |
| 4,799,276 | 1/1989 | Kadish | 5/453 |
| 4,803,744 | 2/1989 | Peck et al. | 5/453 |
| 4,825,486 | 5/1989 | Kimura et al. | 5/453 |
| 4,838,309 | 6/1989 | Goodwin | 137/554 |
| 4,840,425 | 6/1989 | Noble | 5/453 |
| 4,852,195 | 8/1989 | Schulman | 5/453 |
| 4,862,921 | 9/1989 | Hess | 137/861 |
| 4,864,671 | 9/1989 | Evans | 5/453 |
| 4,896,389 | 1/1990 | Chamberland | 5/453 |
| 4,907,308 | 3/1990 | Leininger et al. | 5/455 |
| 4,914,760 | 4/1990 | Hargest et al. | 5/453 |
| 4,914,771 | 4/1990 | Afeyan | 5/453 |
| 4,935,968 | 6/1990 | Hunt et al. | 5/453 |
| 4,941,221 | 7/1990 | Kanzler | 5/60 |
| 4,942,635 | 7/1990 | Hargest et al. | 5/453 |
| 4,944,060 | 7/1990 | Peery | 5/453 |
| 4,949,412 | 8/1990 | Goode | 5/453 |
| 4,949,413 | 8/1990 | Goodwin | 5/453 |
| 4,949,414 | 8/1990 | Thomas et al. | 5/453 |
| 4,953,247 | 9/1990 | Hasty | 5/453 |
| 4,962,552 | 10/1990 | Hasty | 5/453 |
| 4,967,431 | 11/1990 | Hargest et al. | 5/453 |
| 5,003,654 | 4/1991 | Vrzalik . | |
| 5,005,240 | 4/1991 | Vrzalik | 5/453 |
| 5,008,965 | 4/1991 | Vrzalik . | |
| 5,022,110 | 6/1991 | Stroh | 5/455 |
| 5,029,352 | 7/1991 | Hargest et al. | 5/453 |
| 5,035,014 | 7/1991 | Blanchard | 5/424 |
| 5,036,559 | 8/1991 | Hargest | 5/453 |
| 5,044,029 | 9/1991 | Vrzalik | 5/453 |

| | | | |
|---|---|---|---|
| 5,051,673 | 9/1991 | Goodwin | 318/481 |
| 5,052,067 | 10/1991 | Thomas et al. | 5/453 |
| 5,062,167 | 11/1991 | Thomas et al. | 5/61 |
| 5,065,464 | 11/1991 | Blanchard et al. | 5/81 |
| 5,065,466 | 11/1991 | Thomas et al. | 5/453 |
| 5,073,999 | 12/1991 | Thomas et al. | 5/61 |
| 5,090,074 | 2/1992 | Scales et al. | 5/448 |
| 5,090,077 | 2/1992 | Caden et al. | 5/456 |
| 5,092,007 | 3/1992 | Hasty | 5/453 |
| 5,095,568 | 3/1992 | Thomas et al. | 5/453 |
| 5,111,544 | 5/1992 | Graebe | 5/470 |
| 5,121,513 | 6/1992 | Thomas et al. | 5/453 |
| 5,138,729 | 8/1992 | Ferrand | 5/453 |
| 5,142,719 | 9/1992 | Vrzalik | 5/609 |
| 5,152,021 | 10/1992 | Vrzalik | 5/455 |
| 5,152,023 | 10/1992 | Graebe | 5/455 |
| 5,163,196 | 11/1992 | Graebe et al. | 5/654 |
| 5,168,589 | 12/1992 | Stroh | 5/455 |
| 5,182,826 | 2/1993 | Thomas et al. | 5/453 |
| 5,235,713 | 8/1993 | Guthrie | 5/453 |
| 5,249,318 | 10/1993 | Loadsman | 5/453 |
| 5,251,349 | 10/1993 | Thomas et al. | 5/453 |
| 5,269,030 | 12/1993 | Pahno et al. | 5/604 |
| 5,323,500 | 6/1994 | Roe et al. | 5/713 X |
| 5,373,595 | 12/1994 | Johnson et al. | 5/713 X |
| 5,375,273 | 12/1994 | Bodine, Jr. et al. | 5/455 |
| 5,388,292 | 2/1995 | Stinson | 5/453 |
| 5,421,044 | 6/1995 | Steenson | 5/455 |
| 5,487,196 | 1/1996 | Wilkinson et al. | 5/453 |
| 5,586,346 | 12/1996 | Stacy et al. | 5/715 X |
| 5,611,096 | 3/1997 | Bartlett et al. | 5/617 |
| 5,813,067 | 9/1998 | Stacy et al. | 5/713 X |

FOREIGN PATENT DOCUMENTS

| | | | |
|---|---|---|---|
| 7639097 | 7/1977 | Germany | A61G 7/04 |
| 2614861 | 10/1977 | Germany | A47C 27/10 |
| 2816642 | 10/1978 | Germany | A61G 7/04 |
| 2919438 | 11/1980 | Germany | A61G 7/04 |
| 3217981 | 11/1982 | Germany | A61G 7/04 |
| 3303615 | 8/1984 | Germany | A47C 27/10 |
| 3535374 | 4/1987 | Germany | A47C 27/10 |
| 3716263 | 11/1988 | Germany | A47C 27/08 |
| 9010880 | 1/1991 | Germany | A61G 7/05 |
| 48-37990 | 6/1973 | Japan . | |
| 53-98793 | 1/1977 | Japan | A61G 7/02 |
| 52-20173 | 2/1977 | Japan | A61G 7/04 |
| 55-18008 | 4/1980 | Japan | A61G 7/04 |
| 56-6106 | 2/1981 | Japan | A61G 7/04 |
| 56-13946 | 4/1981 | Japan | A61G 7/04 |
| 56-17099 | 4/1981 | Japan | A61G 7/04 |
| 57-179866 | 11/1982 | Japan | A47C 27/10 |
| 57-189462 | 12/1982 | Japan | A47C 27/08 |
| 58-16124 | 2/1983 | Japan | A61G 7/04 |
| 58-58033 | 4/1983 | Japan | A61G 7/04 |
| 58-89028 | 6/1983 | Japan | A61G 7/04 |
| 58-169447 | 10/1983 | Japan | A61G 7/00 |
| 59-71626 | 5/1984 | Japan | A61G 7/04 |
| 59-93524 | 6/1984 | Japan | A61G 7/04 |
| 60-45022 | 3/1985 | Japan | A61G 7/04 |
| 60-45023 | 3/1985 | Japan | A61G 7/04 |
| 60-55425 | 4/1985 | Japan | A61G 7/04 |
| 60-152355 | 10/1985 | Japan | A47C 23/00 |
| 61-115533 | 7/1986 | Japan | A61G 7/04 |
| 61-163631 | 10/1986 | Japan | A61G 7/04 |
| 61-276557 | 12/1986 | Japan | A61G 7/04 |
| 62-21328 | 2/1987 | Japan | A61G 7/04 |
| 63-46157 | 2/1988 | Japan | A61G 7/04 |
| 2-32264 | 9/1990 | Japan | A61G 7/05 |
| 4-15467 | 2/1992 | Japan | A61G 7/05 |
| 122806 | 2/1919 | United Kingdom . | |
| 762528 | 11/1956 | United Kingdom . | |
| 796746 | 6/1958 | United Kingdom . | |
| 946831 | 1/1964 | United Kingdom . | |
| 949652 | 2/1964 | United Kingdom . | |
| 958651 | 5/1964 | United Kingdom . | |
| 959103 | 5/1964 | United Kingdom . | |
| 969367 | 9/1964 | United Kingdom . | |
| 1023097 | 3/1966 | United Kingdom | A47C 27/08 |
| 1059100 | 2/1967 | United Kingdom | A51G 7/00 |
| 1118740 | 7/1968 | United Kingdom | A47C 27/08 |
| 1126364 | 9/1968 | United Kingdom | A47C 27/08 |
| 1222710 | 2/1971 | United Kingdom | A47C 27/10 |
| 1273342 | 5/1972 | United Kingdom | A47C 27/08 |
| 1286197 | 8/1972 | United Kingdom | A61G 7/04 |
| 1291015 | 9/1972 | United Kingdom | A61G 7/04 |
| 1341325 | 12/1973 | United Kingdom | A47C 27/08 |
| 1398544 | 6/1975 | United Kingdom | A61G 7/04 |
| 1440193 | 6/1976 | United Kingdom | A47C 27/10 |
| 1442994 | 7/1976 | United Kingdom | A47C 27/08 |
| 1474018 | 5/1977 | United Kingdom | A47C 19/00 |
| 1483045 | 8/1977 | United Kingdom | A47C 27/08 |
| 1499938 | 2/1978 | United Kingdom | A61G 7/04 |
| 1545806 | 5/1979 | United Kingdom | A47C 27/08 |
| 2026315 | 2/1980 | United Kingdom | A61G 7/04 |
| 1576641 | 10/1980 | United Kingdom | A61G 7/04 |
| 2059256 | 4/1981 | United Kingdom | A47C 27/10 |
| 1595417 | 8/1981 | United Kingdom | A61G 7/04 |
| 1599422 | 9/1981 | United Kingdom | A47C 27/10 |
| 1601808 | 11/1981 | United Kingdom | F16K 31/365 |
| 1602952 | 11/1981 | United Kingdom | A61G 7/00 |
| 2090734 | 7/1982 | United Kingdom | A61G 7/04 |
| 2107197 | 4/1983 | United Kingdom | A61H 9/00 |
| 2108837 | 5/1983 | United Kingdom | A61G 7/04 |
| 2134382 | 8/1984 | United Kingdom | A47C 27/08 |
| 2141333 | 12/1984 | United Kingdom | A47C 27/08 |
| 2167293 | 5/1986 | United Kingdom | A61G 7/04 |
| 2177594 | 1/1987 | United Kingdom | A47C 27/08 |
| 2177595 | 1/1987 | United Kingdom | A47C 27/08 |
| 2177906 | 2/1987 | United Kingdom | A47C 21/06 |
| 2183471 | 6/1987 | United Kingdom | A61G 7/04 |
| WO 84/04884 | 12/1984 | WIPO | A61G 7/04 |
| WO 86/05973 | 10/1986 | WIPO | A61G 7/04 |
| WO 86-06624 | 11/1986 | WIPO | A61G 7/04 |
| WO 89/03203 | 4/1989 | WIPO | A61G 7/04 |

OTHER PUBLICATIONS

Article, "Air Support Systems for the Prevention of Bed Sores"; J.T. Scales; pp. 259–267; (undated).

Japanese brochure, "Automatice Shifting Mat for Sleeping Positions"; (undated).

Bok Y. Lee; "*Chronic Ulcers of the Skin*"; pp. 191–195; (undated).

Article, "Clinical Notes, Suggestions and New Instruments"; *Air Mattress for Bedsores*—Gardner; vol. 138; No. 8; p. 583; (undated).

Brochure, "Compresseur 'Univar' Pour Matelas Anti–Escarres"; LaDiffusion Technique Francaise; (undated).

Brochure, "Double Bubble"; (undated).

Article, "Economic Aspects of Unconventional Beds and Support Surfaces"; J.E. Smith; pp. 321–326; (undated).

Article, "Experience at Rancho Los Amigos Hospital With Devices and Techniques to Prevent Pressure Sores"; Reswick et al.; pp. 301–310; (undated).

Brochure, "The Future in Lateral Rotation Therapy Has Just Arrived . . . RT2000"; (undated).

Brochure, "Huntleigh's Alternating Pressure Systems"; (undated).

Brochure, "KinAir™ Controlled Air Suspension Therapy Gives Your Patients . . . "; (undated).

Article, "Mattresses for Preventing Pressure Sores in Geriatric Patients"; Bliss et al.; pp. 238–245; (undated).

Article, "Mediscus Low Air–Loss Beds and the Prevention of Decubitus Ulcers"; Melissa J. Beaver; *Critical Care Nurse*; vol. 6, No. 5; pp. 32–39; (undated).
Article, "Mobile and Status Support Systems"; W. Russell Grant; pp. 311–314; (undated).
Article, "Pressure on the Patient"; J.T. Scales; pp. 11–17; (undated).
Article, "Problems of Patient Suport: The Air Fluidised Bed as a Solution"; T.S. Hargest; pp. 269–275; (undated).
Brochure, "Relieving the Pressure"; Alphacare System; (undated).
Report of Study Sponsored by North West Metropolitan Regional Hospital Board; pp. 246–268; (undated).
Article, "Static and Dynamic Support Systems—Pressure Differences on the Body"; Patricia Jeneid; pp. 287–299; (undated).
Brochure, "Therapy Without Compromise . . . Introducing Flexicair Low Airloss Therapy"; (undated).
Swedish Brochure, "Turbo–Puls Antidecubitus System"; (undated).
Article, "The Alternating Pressure Mattress"; Bedford et al.; *Gerontologia Clinica*; vol. 3, No. 2, pp. 69–82; (1961).
Article, "A Consideration of Mechanical Methods of Preventing Bedsores in Elderly Patients"; Mary R. Bliss; *Gerontologia Clinica;* vol. 6; pp. 10–21; (1964).
Article, Preventing Pressure Sores in Hospital: Controlled Trial of a Large–celled Ripple Mattress; Bliss et al.; *British Medical Journal;* vol. 1, pp. 394–397; (1967).
Article, "Patient–Support System Using Low–Pressure Air"; Scales et al.; *The Lancet;* ppe 885–888; (Oct. 23, 1971).
Article, "Alternating Pressure Pads"; *Health Devices;* pp. 248–262; (Jul./Aug. 1972).
Article, "The Prevention and Treatment of Pressure Sores Using Air–support Systems"; Scales et al.; *Paraplegia,* vol. 12, pp. 118–131; (1974).
Advertisement, Watkins and Watson Ltd.; Low Air Loss Bed System from Hospital Equipment and Supplies; vol. 21, No. 2; (Feb. 1975).
Advertisement, Hogg Control Systems Ltd. Alternating Pressure Mattress from Hospital Equipment and Supplies (Mar. 1975).
Advertisement, Low Air Loss Bed System from Hospital Equipment and Supplies; vol. 21, No. 8; (Aug. 1975).
Advertisement, International Hospital Equipment Brochure; No. 2; Low Air Loss Bed System (Aug./Sep. 1975).
Article, *Bedsore BioMechanics,* Kenedi et al, Ed.; pp. v–xxvi, 1, 11–17, and 259–326; (1976).
Advertisement, Hogg Control Sys. Ltd. from Hospital Equipment and Supplies; (May 1976).
Article, "Air Beds Cost–Effective Prevention of Bed Sores"; from Hospital Equipment and Supplies; (Mar. 1977).
Advertisement, Gaymar Alternating Pressure Pads from International Hospital Equipment; (May 1977).
Article, "The Use of Ripple Beds in Hospital" Dr. M.R. Bliss; *Hospital and Health Services Review;* pp. 190–193; (Jun. 1978).
Article, "Leaving No Ripple", *The Lancet;* pp. 247–248; (Jul. 29, 1978).
Brochure, International Hospital Equipment Alphabed Advertisement; (Jul. 1979).
Advertisement, Pulsair from Hospital Equipment and Supplies; (Sep. 1979).
Brochure, International Hospital Equipment Talley Medical Equipment Ltd. Advertisement; (Oct. 1979).
Article, "Reducing Devices for Pressure Sores with Respect to Nursing Care Procedures"; Steffel et al.; *Nursing Research;* Accepted for publication Nov. 1979.
Brochure, International Hospital Equipment Rippling Mattress Advertisement; (Nov. 1979).
Advertisement, Mediscus Mark V from Exhibition Supplement; British Hospitals Exhibition; 1980.
Advertisement, "This is no Ordinary Ripple Bed"; The Astec AP Bed; from HES; (Mar. 1980).
Advertisement, "The Pressure's Off. And the Moisture's Gone."; and "Special Beds" from HES (Oct. 1980).
Article, *Preventing Decubitus Ulcers;* CURN Project—Michigan Nurses Assoc., pp. 68–71 and 141–142; (1981).
Brochure, International Hospital Equipment Mediscus Mark V Model Air Bed; (May 1981).
Advertisement, Mayflower Products Pulsating Bed and Medical Cushion from HES; (Oct. 1981).
Article, "Decubitus Prophylaxis: A Prospective Trial on the Efficiency of Alternating–Pressure Air–Mattresses and Water–Mattresses"; Andersen et al.; *Acta Dermatovener;* vol. 63; pp. 227–230; (1982).
Brochure, International Hospital Equipment Medisucs Mark V and Minor Air Beds; (Jan. 1982).
Article, "Use of the 'Air Wave System' to Prevent Pressure Sores in Hospital"; Smith et al.; *The Lancet;* pp. 1288–1290; (Jun. 5, 1982).
Advertisement, Mediscus Products, Ltd. Air Bed from HES; (Jul. 1982).
Brochure, International Hospital Equipment Advertisement for APP–50 Mini Pillo Pump/Pillo Pad System; (Nov. 1982).
Brochure, International Hospital Equipment Advertisement for Astec A.P. Bed; (May 1983).
Advertisement, "The Choice is Yours From M&F"; from HES; (Sep. 1983).
Brochure, "The Mediscus Mark V–A Pressure Treatment System . . . "; (1984).
Article, "New Design of an Anti–Decubitus Lying–Down Support"; Maarten E. Swart; *Int. J. Rehab. Research,* vol. 8, No. 3, pp. 273–280; (1985).
Article, "Special Mattresses: Effectiveness in Preventing Decubitus Ulcers in Chronic Neurologic Patients"; Daehsel; *Arch. Phys. Med. Rehabil.;* vol. 66, pp. 246–248; (Apr. 1985).
Article, "Effectiveness of mattress overlays in reducing interface pressures during recumbancy"; Krouskop et al.; *Journal of Rehabilitation Resarch and Development,* vol. 22, No. 3, pp. 7–10; (Jul. 1985).
Instruction Manual, "Mediscus Mark 5A–M(1–Piece) Air Support Therapy"; Mediscus Products, Ltd.; (1986).
Japanese article, "Bed Sore–Preventing Mat"; Naruse et al.; *Matsushita Denka Giho,* No. 33, pp. 22–27; (Aug. 1986).
Advertisement, "Low air loss bed" from HES; (Aug. 1986).
Article, "Pressure Sores Among Hospitalized Patients"; Allman et al.; reprinted from *Annals of Internal Medicine,* vol. 105, No. 8, pp. 337–342; (Sep. 1986).
Advertisement, Pegasus Airwave System from *Care Science and Practice;* vol. 4, No. 3; (Dec. 1986).
Publication, "Air–Fluidized Beds or Conventional Therapy for Pressure Sores"; Allman et al.; *Annals of Internal Medicine;* vol. 107, pp. 641–648; (1987).
Article, "A Comparison of the Clinisert Pressure Relief System to Other Pressure Sore Prevention Products"; Paul F. Moson; (Jan. 1987).
Advertisement, "The Specialists in Pressure Area Care Products"; Pegasus Airwave Ltd.; from HES; (Nov. 1987).

Article, "DRGS and Pressure Sores: What is Reimbursable and what is Not"; Velez–Campos et al.; reprinted from *Journal of Enterostomal Therapy;* vol. 14, No. 6; pp. 243–247; (Nov./Dec., 1987).
Article, "Interface Skin Pressures on the Therapulse Bed"; Linda Dean; (Apr. 1988).
Dr. Volkner's Lamellar Turning Mattress, Apr., 1990.
Advertisement, "ProMotion. The ProAire Portable Rotation System," *Bio Clinic, Sunrise Medical © 1993*.
Advertisement, "$Q_2$ Plus, Pre or Post Care to Kinetic Therapy," *Kinetic Concepts, Inc.* © 1993.
Advertisement, "Home Kair D.M.S. Dynamic Mattress System," *Kinetic Concepts, Inc.,* Aug. 1993.
Brochure, "AkroTech 4000T," *Lumex* © 1994, Oct. 1994.
Brochure, MICROAIR Turn–Q, Automatic Turning Mattress With Low Air Loss, *Invacare Corp.* © 1993, Rev. 082694.
Brochure, "PNEU–Care Plus–Kinetic Series, Air Support Therapy Mattress Replacement," *Cardio Systems* (Undated).

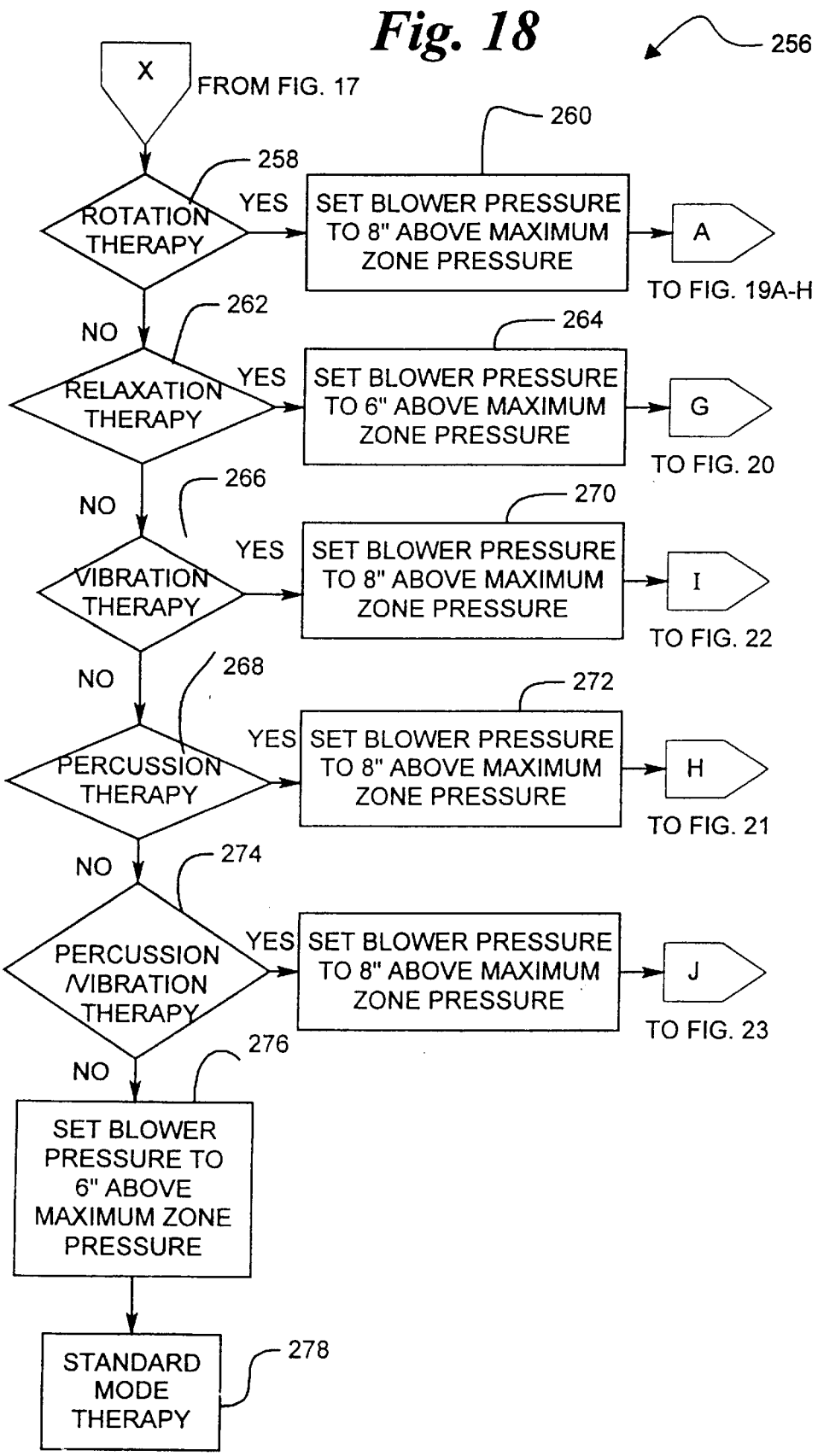
Fig. 18
256
X
FROM FIG. 17
258
ROTATION THERAPY
YES
260
SET BLOWER PRESSURE TO 8" ABOVE MAXIMUM ZONE PRESSURE
A
TO FIG. 19A-H
NO
262
RELAXATION THERAPY
YES
264
SET BLOWER PRESSURE TO 6" ABOVE MAXIMUM ZONE PRESSURE
G
TO FIG. 20
NO
266
VIBRATION THERAPY
YES
270
SET BLOWER PRESSURE TO 8" ABOVE MAXIMUM ZONE PRESSURE
I
TO FIG. 22
NO
268
PERCUSSION THERAPY
YES
272
SET BLOWER PRESSURE TO 8" ABOVE MAXIMUM ZONE PRESSURE
H
TO FIG. 21
NO
274
PERCUSSION /VIBRATION THERAPY
YES
SET BLOWER PRESSURE TO 8" ABOVE MAXIMUM ZONE PRESSURE
J
TO FIG. 23
NO
276
SET BLOWER PRESSURE TO 6" ABOVE MAXIMUM ZONE PRESSURE
STANDARD MODE THERAPY
278

439
440
441
442
443
444
446a
446b
447
448a
448b
449
450b
451
452a
452b
454a
454b
456a
456b
458
458a
460
462
464
465
70
28c

METHOD AND APPARATUS FOR SUPPORTING AND FOR SUPPLYING THERAPY TO A PATIENT

This is a continuation of application Ser. No. 08/780,050 filed Dec. 23, 1996, which is a continuation of Ser. No. 08/196,047 filed Feb. 15, 1994, now U.S. Pat. No. 5,586,346.

BACKGROUND OF THE INVENTION

The present invention relates generally to inflatable support surface beds, and more specifically relates to inflatable support surface beds providing low air loss patient support, or providing other therapies, to a patient supported thereon.

Numerous types of inflatable patient support surfaces have been proposed to support patients. One generic configuration of such a support system in use today includes a plurality of transverse air bags extending across the width of the bed support surface. A plurality of such bags are arranged in parallel to form either a part, or the entirety, of the patient support surface. As is well known relative to such beds, a blower supplies air through a manifolding system to each of the air bags. This manifolding system includes a controller, such as a microprocessor controller, which operates a plurality of valves to control the air flow to sets of one or more of the air bags forming "zones" of the bed.

One therapy offered by such beds is low air loss patient support. In this configuration, at least some of the bags will include either small apertures, or will be formed in whole or in part of air permeable fabric, to provide a flow of air to dry the bag and/or cover surface to thereby reduce the risk to the patient of bed sores.

Another therapy offered in conventional beds is turning, or lateral rotation, of the patient. Dramatically different systems exist in the prior art for turning a patient with transverse air bags. For example, one conventional system deflates alternate single-celled air bags along the length of the patient to allow the patient to drop into recesses or cutouts in the other set of air bags, which remain fully inflated. Another, different, system utilize the deflation of cells in multi-celled cushions all along the length of one side of the patient to lower that side of the patient, and the corresponding inflation of cells all along the length of the other side of the patient to simultaneously raise that side of the patient. The different approaches of each of the systems may present disadvantages in certain situations, however. Both systems can offer less than optimal patient support over a long term in some applications.

Other therapies which are found in conventional acute care beds include pulsation and percussion. Pulsation, or alternating of contact (support) points, has long been utilized in an attempt to reduce patient tissue damage, such as decubitus ulcers. Examples of such alternating pressure surfaces include U.S. Pat. No. 2,998,817 to Armstrong, issued Sep. 5, 1961; and EPO Application No. 0-168-215 to Evans, published Jan. 15, 1986. Percussion therapy consists of a sharp impact of pressure, preferably only in the chest area of the patient, to assist in maintaining portions of the patients' body, typically the lungs, clear of pooled fluid. Conventional apparatus utilize a quick inflation of a cell beneath the patient to provide the impact. The frequency of the percussive therapy may be increased to provide vibratory therapy.

Notwithstanding what therapies are offered, a primary concern with an inflatable bed or support surface is patient comfort. Because patients may remain on these types of beds for extended periods of time, the ability to provide an optimally comfortable support surface is an important objective of any inflatable support assembly. This objective remains even when therapies such as those discussed above are offered.

Another objective of an inflatable support assembly will be to provide a system to maintain a patient properly positioned on the bed during normal situations. This may be of particular importance during rotational therapy. The prior art has only achieved this objective with a limited degree of success.

Accordingly, the present invention provides a new method and apparatus for supporting the patient on an inflatable support surface, and for providing optimal comfort and patient positioning, while having the further capacity, as desired, to provide a range of therapies such as, for example, low air loss support, rotation, varying support pressure ("relaxation"), percussion or vibration to the patient.

SUMMARY OF THE INVENTION

The present invention provides a bed having an improved support surface assembly, and provides a bed suitable for providing a variety of therapies to a patient through the improved support surface assembly. The support surface in accordance with the present invention preferably includes at least two independently inflatable layers. In one preferred embodiment of the support surface assembly, a lower layer of the support surface assembly includes first and second longitudinal cushion sets coupled to a support assembly, such as a support plate. The first longitudinal cushion set includes a plurality of generally parallel cells; which, in a particularly preferred embodiment, are formed as separate and distinct cushions. This first set of longitudinal cushions extends a portion of the longitudinal length of the support assembly; i.e., a portion of the longitudinal length or height of the patient. The second longitudinal cushion set is constructed similarly to the first longitudinal cushion set, but extends at a longitudinally offset portion of the length of the support assembly (or of the patient's length). One particularly preferred embodiment of the invention includes three such longitudinal cushion sets, sequentially longitudinally disposed beneath the patient. These longitudinal cushion sets provide control over the patient's positioning in the bed, and are independently inflatable in preferably at least three longitudinally—divided (i.e., laterally offset) groups, to facilitate rotation of the patient to the left and right through selective inflation and deflation of the longitudinally—divided groups.

In this preferred embodiment, disposed between the longitudinal cushion sets and the patient is an inflatable support layer. Preferably, this inflatable support layer is a discrete and separate assembly from the cells forming the lower layer of the support surface assembly. This inflatable support layer is preferably constructed to provide air leakage, or to otherwise facilitate the flow of air through the layer in at least selected locations. Further, this inflatable support layer preferably includes a predetermined number of independently controllable zones distributed around the patient's body whereby the pressure in individual zones can be adjusted to provide optimal patient comfort. Further, in a particularly preferred embodiment, one or more sections of the inflatable layer also include inflatable, relatively laterally external, enclosures which are maintained at a relatively increased pressure relative to a central enclosure to facilitate the cradling of the patient proximate the central portion of the bed. In addition to stabilizing the patient's position, these cradling sections, at a higher pressure, also serve to stabilize the patient during rotation. Again in one particularly embodiment, the inflatable support layer also includes provisions under a selected portion of the patient's body, for example the chest area, for providing percussive or vibratory therapy to the patient to facilitate the loosening and movement of fluids from the patient's lungs.

An exemplary bed including a support surface as described above is preferably controlled through use of a conventional microprocessor system to regulate a plurality of proportional valves which modulate airflow between a blower assembly and the air cushions. Appropriate pressure feedback mechanisms and circuitry are provided to facilitate the microprocessor's monitoring of the pressure in the inflatable air cells relative to predetermined or desired levels, and appropriate regulation of the airflow to the cells.

BRIEF DESCRIPTION OF THE DRAWINGS

FIG. 18 depicts an exemplary flowchart for the setup of blower pressure for a bed in accordance with the present invention.

DETAILED DESCRIPTION OF PREFERRED EMBODIMENT

Figure 1:
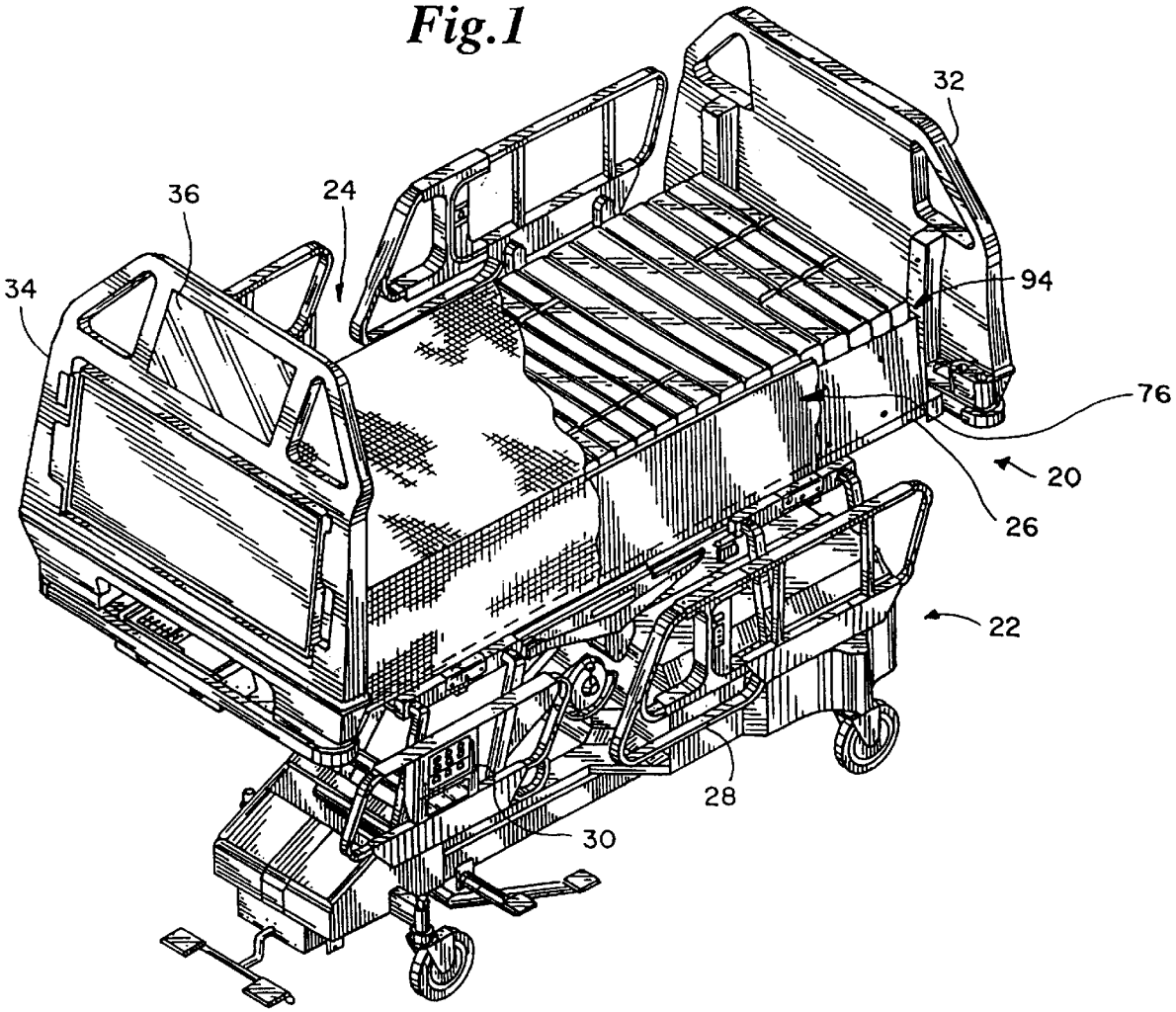
FIG. 1 depicts an exemplary bed constructed in accordance with the present invention.

Referring now to the drawings in more detail, and particularly to FIG. 1, therein is depicted an exemplary bed 20 constructed in accordance with the present invention. Bed 20 includes a support frame assembly, indicated generally at 22, and a support surface assembly, indicated generally at 24.

Support frame assembly 22 preferably includes a conventional, multi-featured hospital bed frame 26, such as the Century Critical Care Frame®, manufactured by Hill-Rom Co., a subsidiary of Hillenbrand Industries, of Batesville, Ind. Bed frame 26 includes conventional bed position functions and controls to change the bed height, articulation, etc.; and also includes conventional mechanisms, such as siderails 28 for patient safety. Coupled to bed frame 26 is a headboard assembly 32 and a footboard assembly 34. Footboard assembly 34 preferably includes a control panel 36 which includes an LCD screen and a plurality of membrane switches. Control panel 36 controls air support and therapy functions of bed 20, as will be described in more detail later herein.

Figure 2:
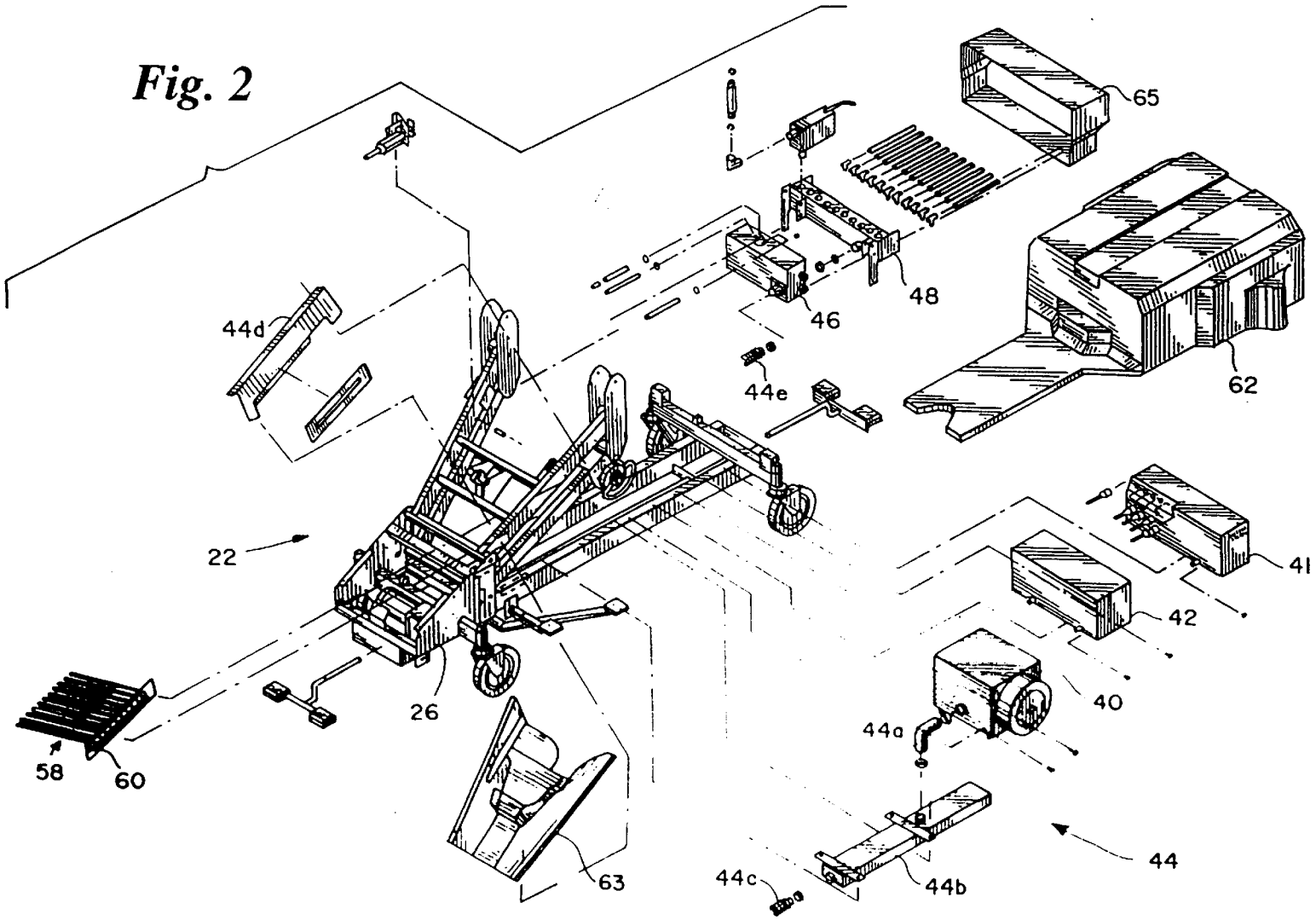
FIG. 2 depicts a support frame assembly of the bed of FIG. 1, depicted in an exploded view.

Referring also to FIG. 2, therein is depicted support frame assembly 22 in an exploded view. Support frame assembly 22 includes a blower and air filter assembly 40 operably coupled to frame 26. Blower and air filter assembly 40 will be selected to provide an output based upon the desired pressure range desired for inflation of the cells in support surface assembly 24 and the determined leakage rates from such cells.

An electrical box 41 and battery assembly 42 are also provided on frame 26. Battery assembly 42 will provide power for the operation of bed 22 during transfer or other interruptions of power. Although bed 20 is designed to operate from conventional AC power (which is converted to DC power), battery assembly 42 includes batteries which provide a supply of DC power to operate at least basic patient support functions during periods of AC power interruption. Battery assembly 42 is of a conventional design and is operably coupled to the electrical control system of bed 20 in a conventional manner.

Blower 40 is operably coupled through an appropriate conduit assembly 44*a*, 44*b*, 44*c*, 44*d*, and 44*e* to an air box 46. Conduit assembly 44 is partially formed of rigid channel conduit elements 44*b* and 44*d*, and includes appropriate flexible elements: flexible conduit 44*a* coupled between blower 40 and channel conduit 44*b*; flexible conduit 44*c* coupled between channel conduit 44*b* and rising conduit 44*d*; and flexible conduit 44*e* coupled between rising conduit 44*d* and air box 46.

Figure 7:
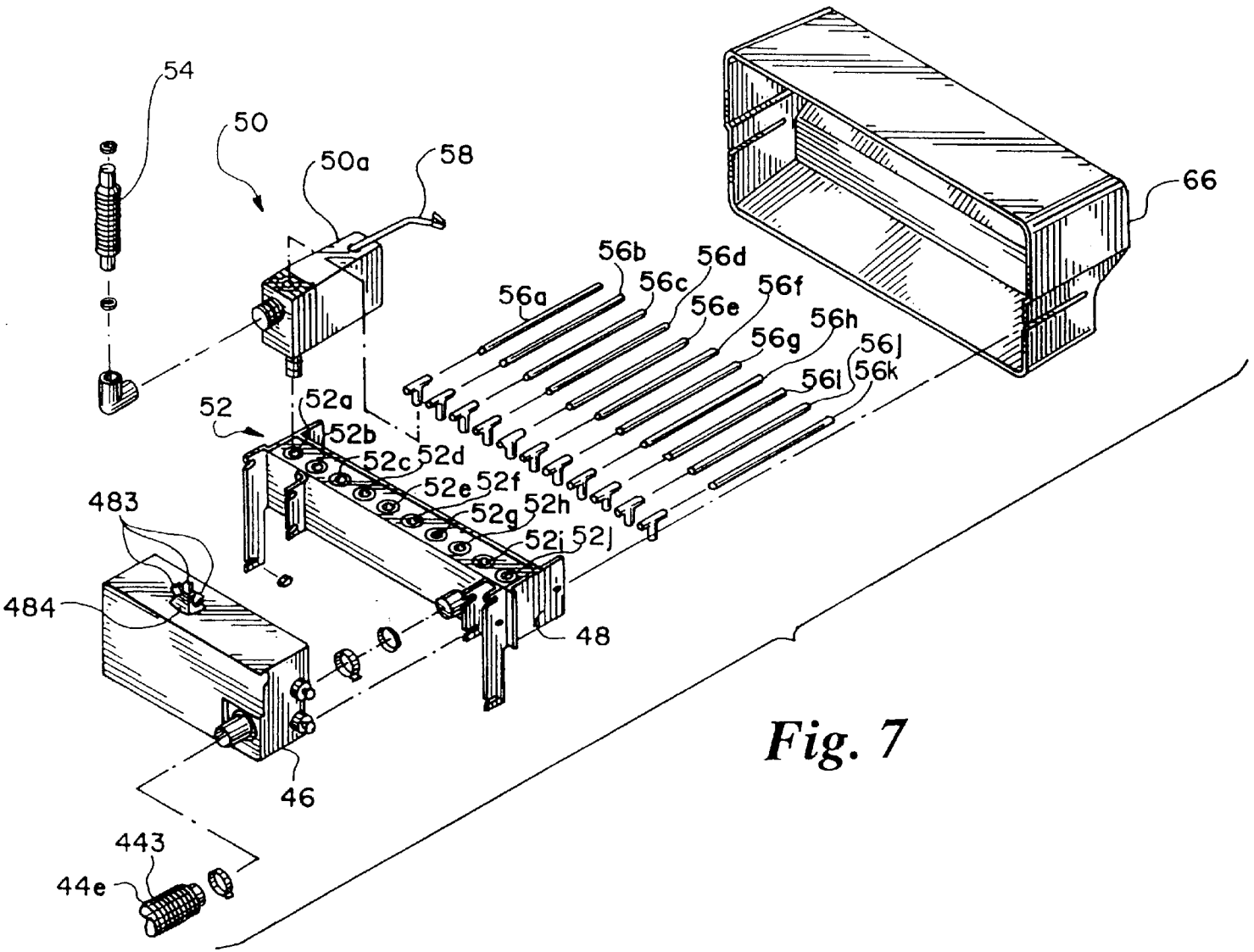
FIG. 7 schematically depicts the air manifold and a valve box of the support frame assembly of FIG. 2.
Figure 8A:
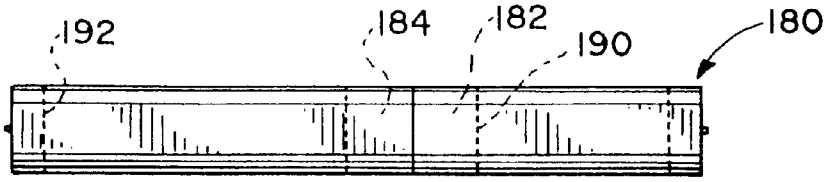
FIGS. 8A–D depicts a head section working cushion of the support surface assembly of FIG. 3, illustrated with internal structure depicted in phantom lines; depicted in FIG. 8A from a top view; depicted in FIG. 8B from a side view; depicted in FIG. 8C from a bottom view; and depicted in FIG. 8D from an end view.
Figure 8B:
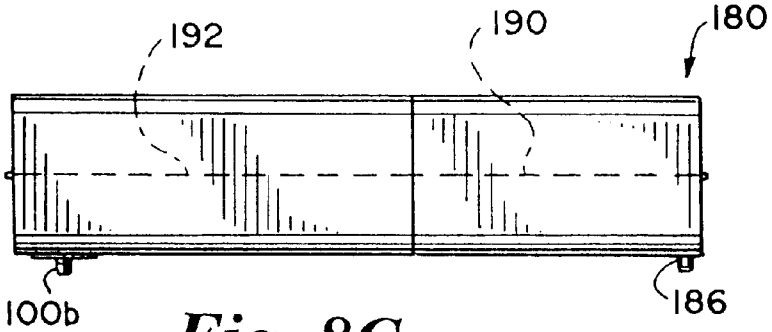
Figure 8C:
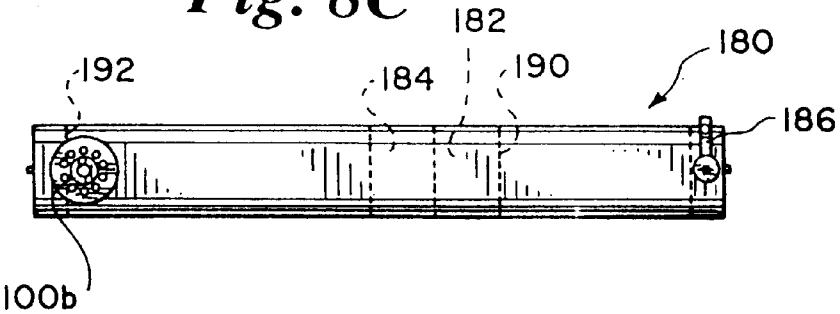
Figure 8D:
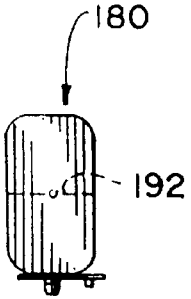
Figure 31:
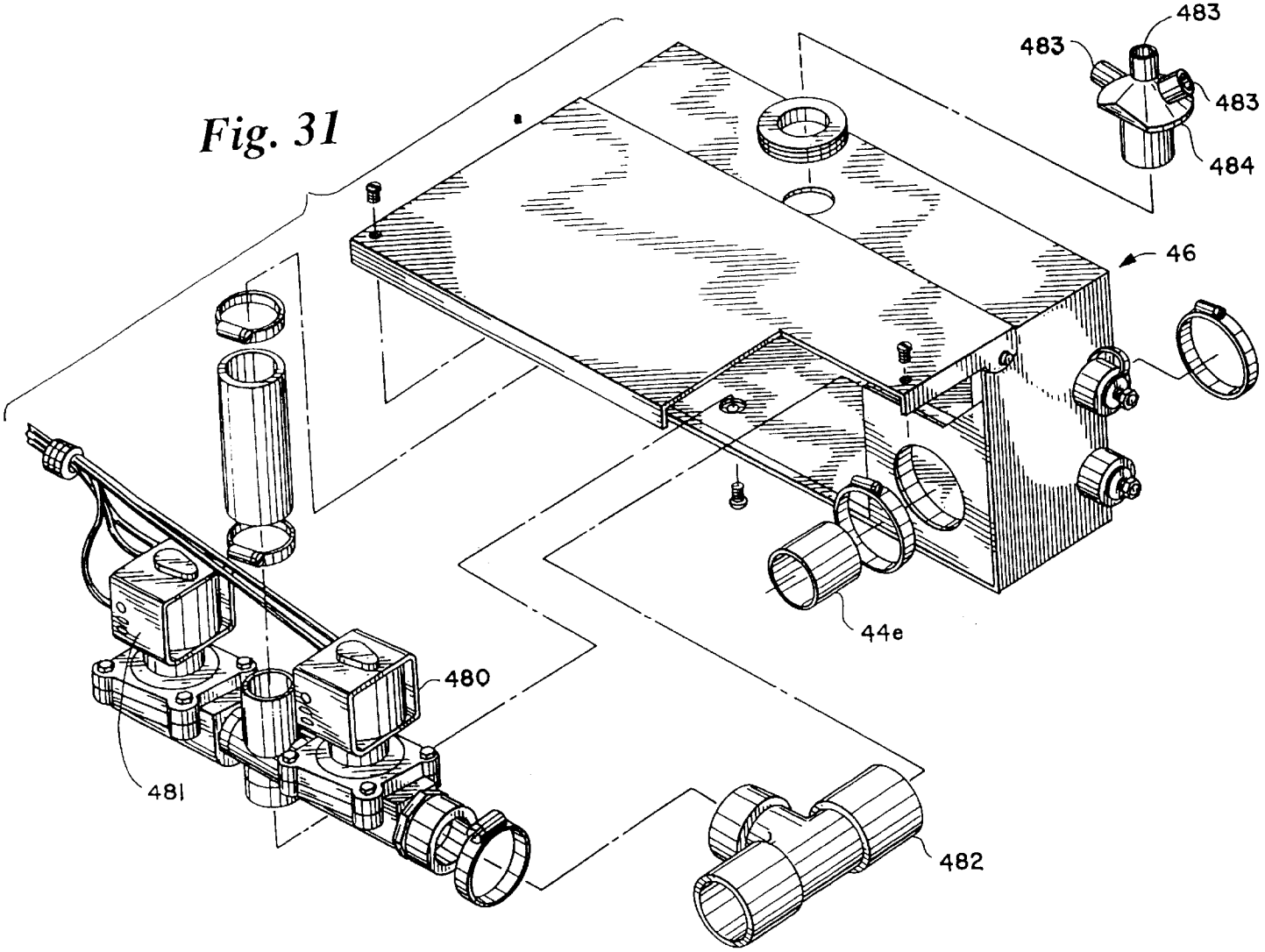
FIG. 31 depicts an exemplary embodiment of air box assembly of FIGS. 2 and 7, depicted in an exploded view to show internal structure.

Referring now also to FIGS. 7 and 31, air box 46 is operably coupled to a valve manifold 48. Each of a plurality of valves 50 (for clarity, only one valve is illustrated) engages an outlet 52*a–j* on valve manifold 48 to selectively supply air to specific air channels throughout support surface assembly 24, as will be described in more detail later herein. A hose assembly 54 couples to each valve 50 to provide fluid communication between the valve outlet 52 and support surface assembly 24.

Air box 46 includes a pair of solenoid valves 480, 481 which are in at least selective fluid communication with air from blower 40 through conduit assembly 44, such as through a T-coupling 482 to which conduit 44*e* is coupled. Solenoid valves 480, 481 provide control of air to outlet 484 to facilitate percussion and vibration therapy, as will be described later herein. Outlet 484 is depicted as having three outlet ports 483 which will be coupled by appropriate tubing to inlet ports 440 (in FIG. 4) on the bottom side of support plate assembly 64 in parallel. Alternatively, more or fewer ports may be provided to facilitate the flow of air through conduits to selected chambers in support surface assembly 24. First air control valve 480 is preferably energized to a normally closed position to block the passage of air to outlet 484. Selective rapid actuation opening valve 480, while valve 481 is in a closed condition will provide a pulse of air to outlet 484 (and thereby to selected chambers, in support surface assembly 24). Subsequent closing of valve 480 while opening valve 481 will allow air to be expelled from outlet 484 through valve 481.

Briefly, as is well-known in the art, each valve 50 is a proportional valve which is individually controlled, through appropriate feedback and control circuitry, by a microprocessor-based controller. As a portion of the feedback control, each valve 50 has a pressure feedback tube 56 (*a–j*) operably coupled between the outlet side of an individual valve 50 and a pressure sensor on a power control circuit board assembly (not illustrated) associated with the valve 50. Additionally, a pressure feedback tube 56*k* is utilized to monitor pressure in manifold 48.

An exemplary structure and method of operation of air control valves is described generally in U.S. Pat. No. 5,251,349, issued Oct. 12, 1993 to Thomas et al.; the disclosure of which is hereby incorporated herein by reference for all purposes. It should be understood, however, that any of a number of conventionally known valve configurations may be utilized with the present invention. Alternatively, each air control valve may be as disclosed in U.S. patent application Ser. No. 08/088,541, entitled "Proportional Control Valve for Patient Support System," filed Jul. 7, 1993 in the names of Ryszard S. Ozarowski et al. and assigned to the owner of the present invention; the disclosure of which is hereby incorporated herein by reference for all purposes.

A plurality of air channel monitoring tubes 58 are also each cooperatively arranged, at a first end with a valve 50 outlet, and at a second end to an access plate 60. Each monitoring tube 58 will be closed proximate access plate 60 by a conventional releasable sealing mechanism (not illustrated). Air channel monitoring tubes 58 allow the external monitoring and/or variation of pressures within individual air channels in support plate assembly 64.

As is familiar to those skilled in the art, a plurality of shroud panel assemblies 63, 64, and 65 attach to bed frame 26 to protect components of support frame assembly 22 and to provide aesthetic appeal of the assembly.

Figure 3:
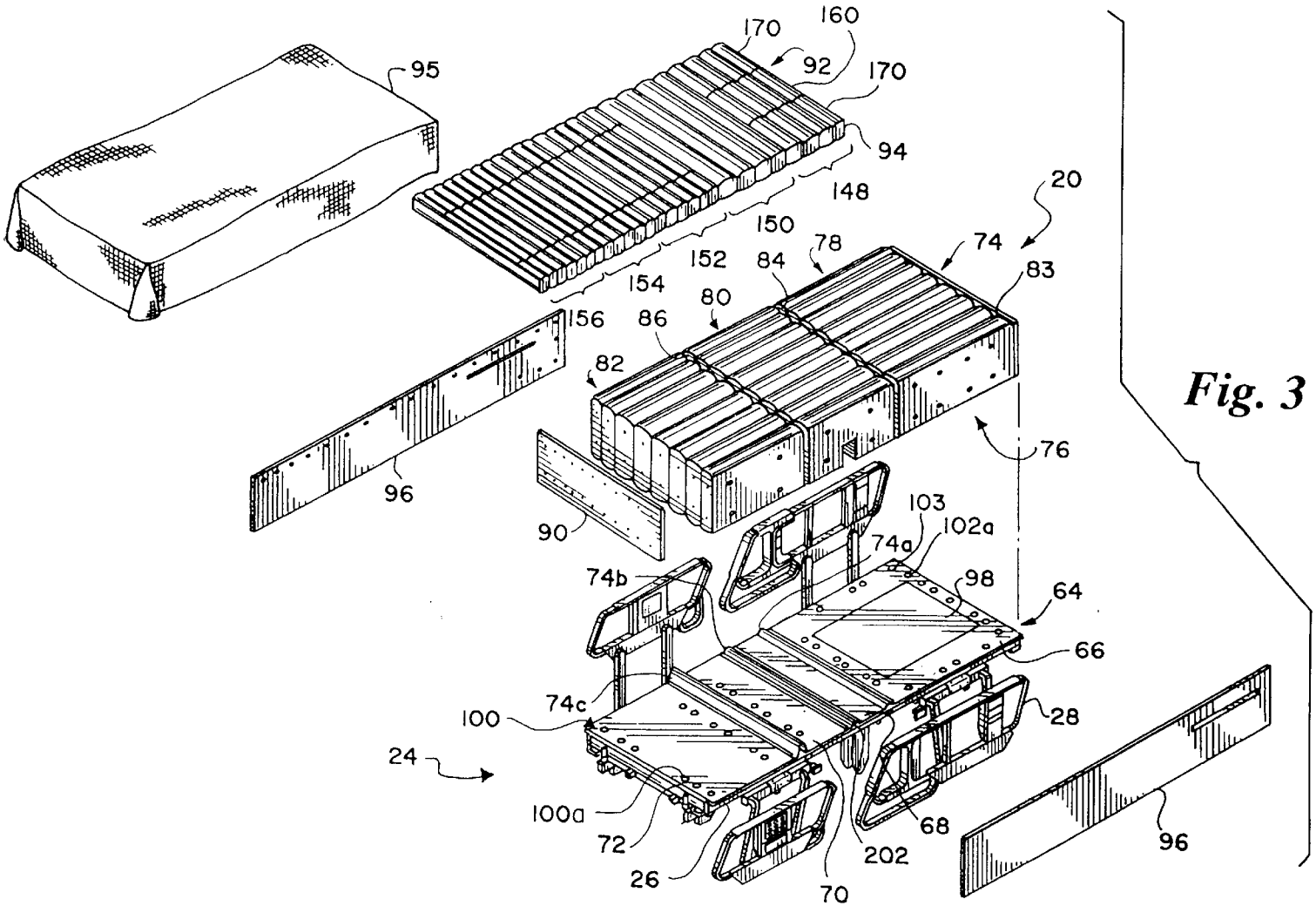
FIG. 3 depicts the support surface assembly of the bed of FIG. 1, also depicted in an exploded view.
Figure 24:
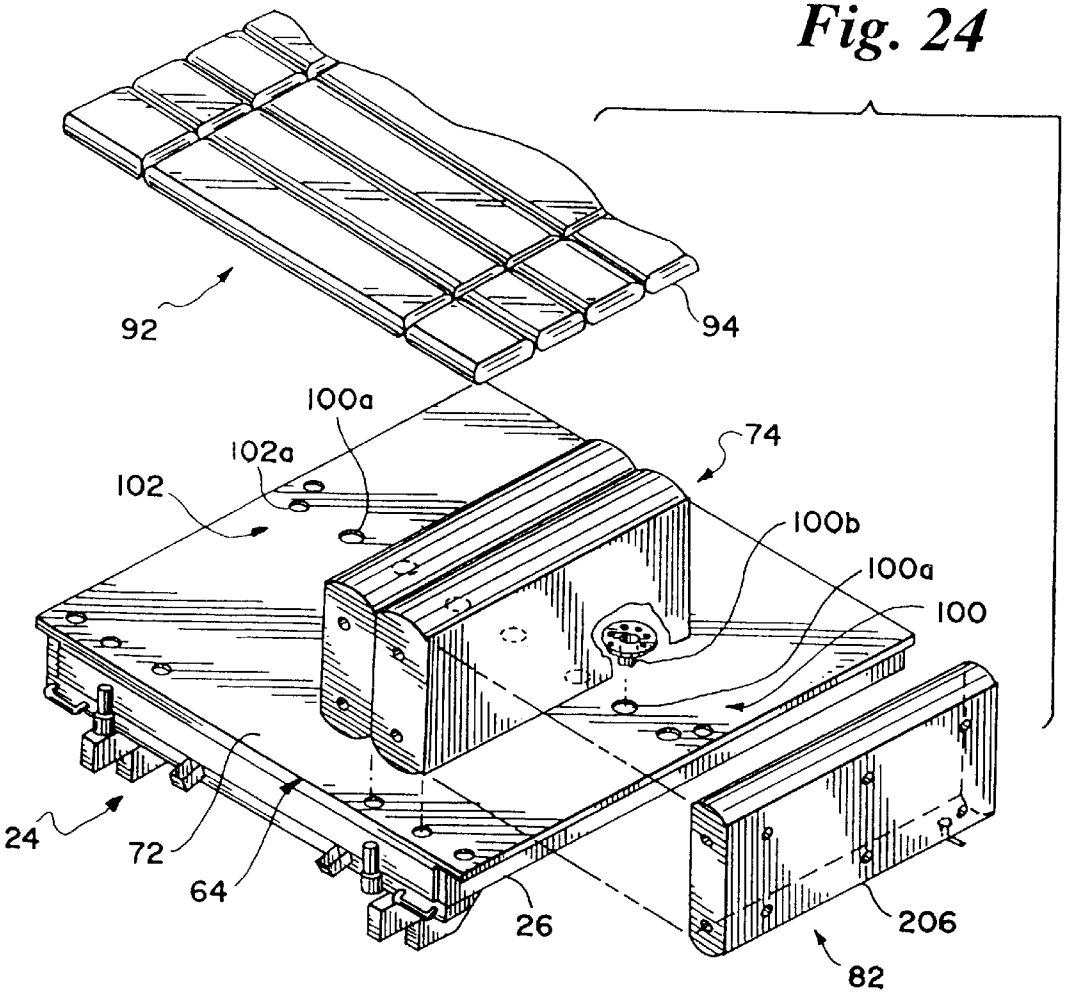
FIG. 24 depicts a portion of the insertion of working cushions on a portion of support frame assembly of support surface assembly of FIG. 3.

Referring now primarily to FIGS. 3 and 24, therein is depicted support surface assembly 24 in greater detail. Coupled to bed frame 26 (only a portion of which is depicted for clarity) is a support plate assembly, indicated generally at 64. Support plate assembly 64 provides a solid surface upon which is supported a first, lower, inflatable level 74 and a second, upper, inflatable level 92. As will be described in more detail later herein, lower inflatable layer 74 and upper inflatable layer 92 are preferably each divided into a plurality of zones, separately coupled to individual proportional air control valves 50.

Support plate assembly 64 preferably includes a plurality of four individual sections, 66, 68, 70, and 72, operably coupled to bed frame 26 to extend generally the full length between headboard assembly 32 and footboard assembly 34 (see FIG. 1). First support frame section 66 includes a central radiolucent panel 98. As is known to the art, radiolucent panel 98 is preferably formed of a composite phenolic resin, such as is known by the trade name Recitin; and facilitates the taking of X-rays of a patient without removing the patient from the bed 20. A flexible strip 74*a–c* is secured between adjacent sections 66, 68, 70, and 72 of support plate assembly 64 to cover spaces between the sections which may change in size as bed frame 26 is articulated, thereby tilting sections 66, 68, 70, and 72 relative to one another.

Support plate assembly 64 includes a plurality of releasable air connector members which facilitate releasable connections between enclosures in lower inflatable layer 74 and upper inflatable level 92. In a preferred implementation, a first, pull-release "quick disconnect" form of connector, indicated generally at 100, is utilized to selectively engage complimentary connectors on the air cushions of lower inflatable level 74; and a second manual-release form of connector, indicated generally at 102, is utilized to selectively engage complimentary connectors and tubing coupled to upper inflatable level 96 to establish fluid communication therewith. Quick disconnect connector members 100*a* (schematically represented by large circles in FIG. 4, and as exemplary identified at 504, 506, and 508 in FIG. 4), are configured to engage complimentary connector members 100*b* on the cushions of lower inflatable level 74, and are generally described in reference to FIGS. 2, 3, 5, and 6 of U.S. Pat. No. 5,251,349 to Thomas, et al., previously incorporated by reference. Connector members as depicted in U.S. Pat. No. 5,251,349 include a flange which rests against the upper surface of the support plate and an extension which extends through the support plate and to which a threaded coupling is attached to secure the connector member to the support plate. As an alternative, and preferred, construction, the flange of the connector may include a plurality of apertures to facilitate the securing of the connector member to the support plate through screws rather than through the described threaded coupling. An exemplary manual release connector 102 (schematically represented by smaller circles in FIG. 4, and as exemplary identified at 502), as is utilized to couple the tubing extending to upper inflatable level 94, is described herein in reference to FIG. 25.

A limited number of clip-retained couplings 103 are utilized to establish fluid communication between support plate assembly 64 and the laterally outermost cushions of lower inflatable layer 74. These couplings are represented by double concentric circles in FIG. 4, and are depicted and discussed herein in relation to FIG. 32.

Figure 4:
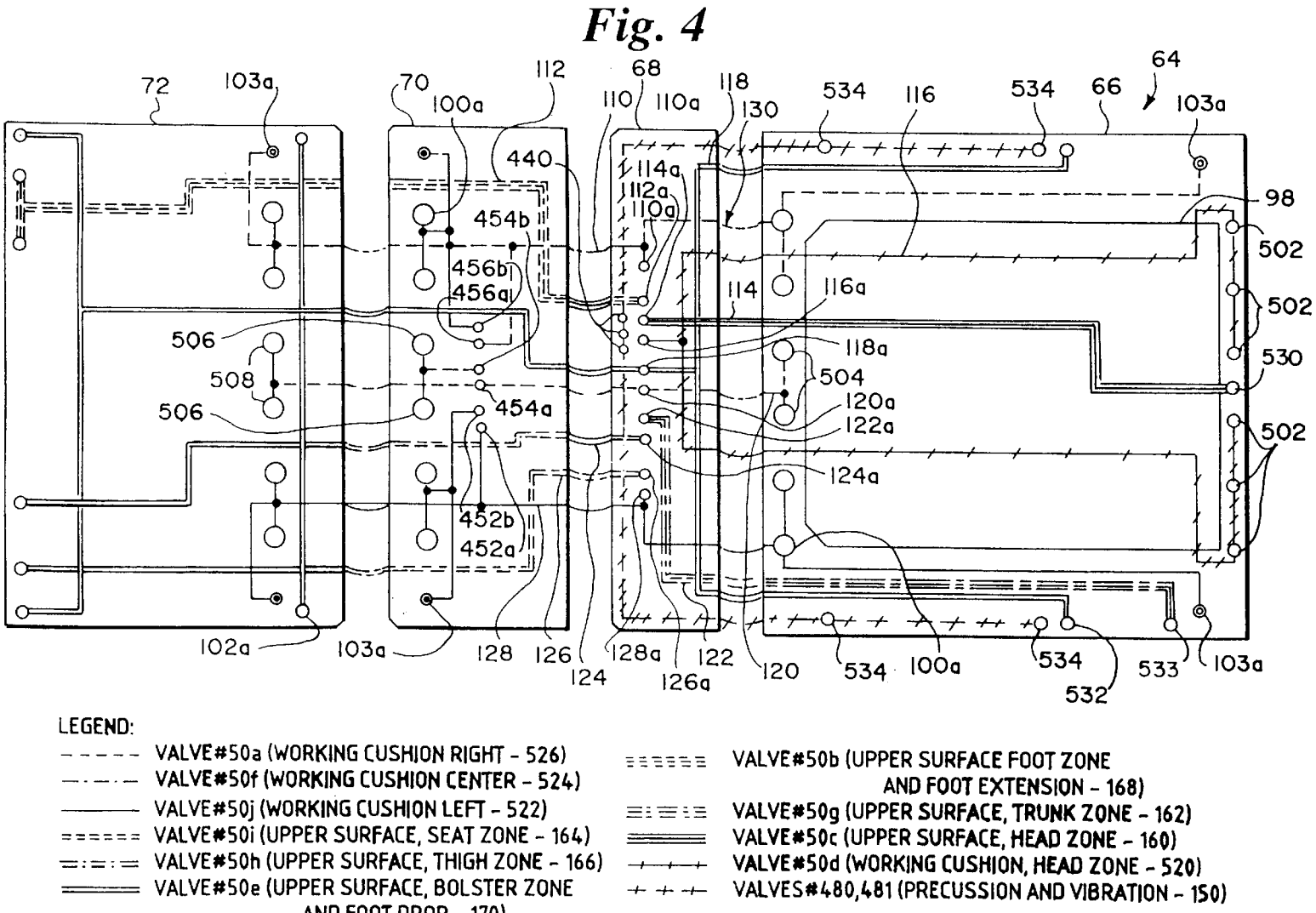
FIG. 4 is a schematic representation of the interconnection of air inlets and outlets in the support plate assembly of the bed of FIG. 1.
Figure 5:
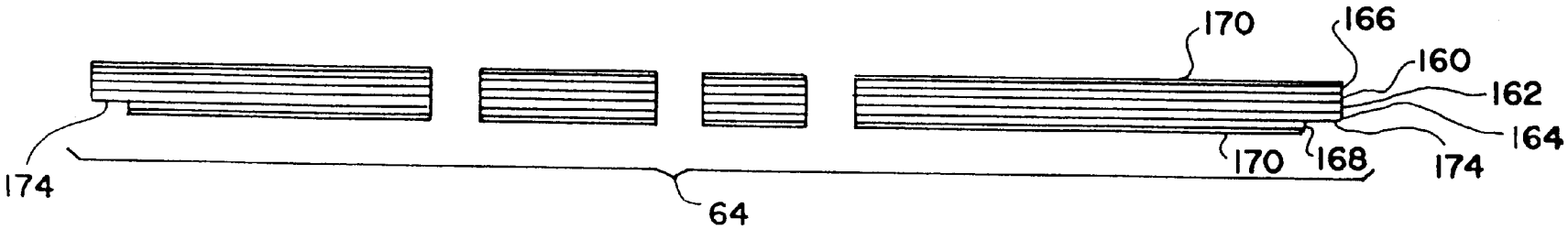
FIG. 5 schematically depicts the vertical construction of the support plate of FIG. 4.
Figure 6:
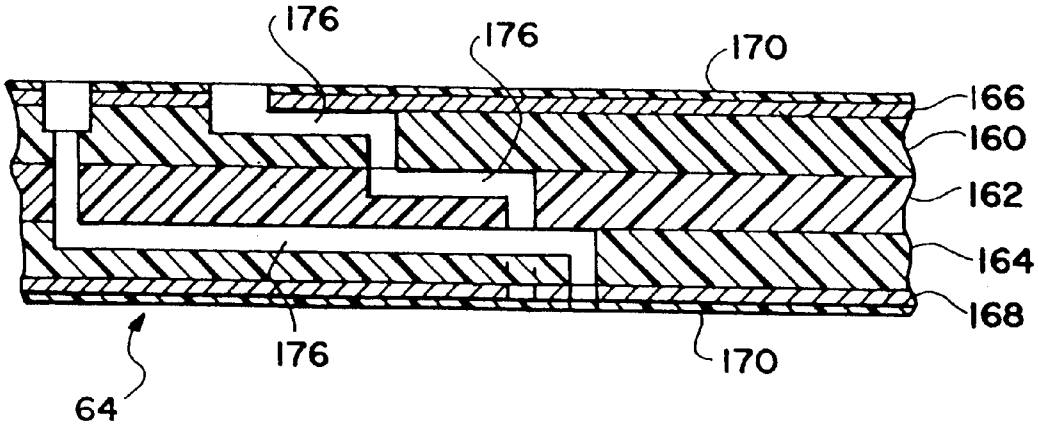
FIG. 6 represents an exemplary illustration of the construction of the support plate assembly of FIG. 4, illustrated in vertical section.

Referring now also to FIGS. 4–6, therein is depicted, in FIG. 4, support plate assembly 64 in a schematic view, and from side views in FIGS. 5 and 6. Support plate assembly 64 is preferably a multi-level composite assembly which defines a plurality of air passageways; and which acts, therefore, as a manifold for distributing air from proportional valves 50 to individual zones in lower inflatable layer 74 and upper inflatable layer 92.

Support plate assembly 64 is preferably constructed of a plurality of PVC layers 160, 162, 164 adhesively coupled together as a central core, with a layer of aluminum plate 166, 168 at the top and bottom, respectively; and with a layer of an external plastic coating 170 extending around the entire assembly. As can best be seen in FIG. 5, support plate assembly 64 is constructed with an exterior recess 174 at the lower surface so that support plate assembly 64 will fit partially within the confines of bed frame 26. To form exterior recess 174, support frame assembly 64 preferably includes only two PVC layers 160, 162, proximate the exterior edge, and includes only the upper aluminum layer 166 proximate the exterior edge.

In one particularly preferred embodiment, each PVC layer 160, 162, 164 will be formed of a layer of expand ed PVC foam having a thickness of approximately ten millimeters (or 0.39 inch). As depicted in FIG. 6, each PVC layer will have paths (indicated exemplary at 176) formed therein to provide the desired flow channels, as schematically depicted in FIG. 4. The PVC layers 160, 162, 164 are bonded together, and to aluminum plates 166, 168, with an adhesive, such as a methacrylate adhesive. Each aluminum plate is preferably approximately 0.067 inch thick. Plastic coating layer 170 may be of any suitable type, such as, for example an ABS/PVC blend, such as that marketed under the name Kydex T, by the Kleerdex Company of Aiken, S.C.

Referring primarily to FIG. 4, each section 66, 68, 70, and 72 of support plate assembly 64 is preferably constructed to define two or three levels of flow paths (see FIG. 6), defining ten distinct flow channels; indicated generally at 110, 112, 114, 116, 118, 120, 122, 124, 126, 128. Each of the above flow channels is operatively coupled to an air inlet 110*a*, 112*a*, 114*a*, 116*a*, 118*a*, 120*a*, 122*a*, 124*a*, 126*a*, 128*a*, respectively on the lower side of section 66. Each such air inlet is coupled through an appropriate conduit 52 to a respective air control valve 50. Each flow channel 110, 112, 114, 116, 118, 120, 122, 124, 126, 128 then extends through support plate assembly 64 to operatively couple to one or more quick disconnect connector members 100*a*, manual release connector member 102*a*, or clip-retained coupling 103 to provide fluid communication between a respective air control valve 50 and one or more cushions of first inflatable levels or zones of second inflatable level 96. In many cases, an air channel 110, 112, 114, 116, 118, 120, 122, 124, 126, 128 extends across one section 66, 68, 70, or 72 of support frame assembly 64 to another such section. For example, air passageway 110 extends at 130 between first section 66 and second section 68 of support plate assembly 64. In such cases, a conventional coupling will be secured to extend from the lower surface of each section, and a flexible tube or bellows (not illustrated) will be connected to the couplings to connect the air channel between such sections.

As can also be seen in FIG. 3, bed 20 includes first, lower inflatable level, indicated generally at 74, supported upon support plate assembly 64. First inflatable level 74 is preferably formed of a plurality of generally longitudinally extending cells. In one preferred embodiment, these longitudinally extending cells are formed of individual longitudinally extending cushions, indicated generally at 76, arranged generally in parallel in three longitudinally—extending, sequentially arranged, groups, 78, 80 and 82.

As can be seen in FIGS. 1 and 3, each group 78, 80, 82 of longitudinal cushions 76 includes eight generally parallel, longitudinally extending cushions. First cushion group 78 will extend primarily under the head and upper torso of the patient. The cushions of first cushion group 78 are coupled together at an upper end by a first fabric panel 83, which couples to the end of each individual cushion, preferably by a pair of conventional snap fittings. First fabric panel thereby serves to maintain the lateral spacing of the cushions of first cushion group 78 at the upper end. All snap fittings are preferably "Pull-The-Dot" snap fittings, such as Model Nos. 92-18100/92-18201, or 92-18302/93-10412 as manufactured by Scovill Fasteners, Inc. of Clarksville, Ga.

The second cushion group 80 will extend primarily under the seat and upper thigh portion of the patient. Each cushion of second cushion group 80 is coupled at an upper end to a respective cushion of first cushion group 78. A transversely-extending fabric panel 84 extends between the cushions of first cushion group 78 and second cushion group 80 and includes apertures therein to facilitate the opening of the cushions through panel 84. Similarly, the cushions of third cushion group 82, which will extend generally under the legs and feet of the patient, are again coupled together at an upper end, by snaps, to the cushions of second group 80 through apertures in a fabric panel 86; and are coupled at the lower end to a fabric panel 90. Each transverse fabric panel 83, 84, 86, and 90 preferably includes at least one tab having a plurality of snap fittings therein to facilitate attachment to side panels 96.

Each cushion 76 is preferably constructed of twill woven nylon coated on the interior surface with a sealing material, such as urethane, so as to make each cushion generally air tight. The cushions of each group will preferably be approximately 7.5 inches high, but will vary in length. In one preferred embodiment, the central six cushions of lower level 74 are each preferably approximately 4 inches wide, while the outermost "bolster" cushions are each approximately 2.5 inches wide. Other than as to material, the "working" cushions of each group 78, 80, and 82 will preferably be constructed somewhat differently from the cushions of other groups. Each working cushion may include at least one connector member which will engage a complimentary connector member on support surface assembly. In the depicted embodiment, the six most central cushions of each cushion group include a quick disconnect connector 100*b* by which the cushions are coupled to a complimentary connector 100*a* secured to support surface 64. The two outermost cushions of each cushion group each include clip-retained fitting (103*b* in FIG. 32) by which fluid communication is established with receptacles 103*a* mounted on support surface 64. Essentially identical side panels 96 will extend the longitudinal length of lower inflatable level 74, and will preferably couple to each outer cushion and to each transverse panel 80, 84, 86, 90 by a plurality of snaps. Each side panel 96 will then also couple, again by a plurality of snaps to an adjacent portion of support frame assembly 22. Each side panel 96 also includes a closeable slot to facilitate the placement of an X-ray film magazine between the cushions of lower inflatable layer 74 and upper inflatable layer 92, if so desired. Such slot may be closeable through use of a zipper, snaps, or a hook and eye fabric fastener.

Referring now to FIGS. 8A–D, therein is depicted an exemplary head section cushion 180 of group 78. In a particularly preferred embodiment, each head section cushion 180 is approximately 32 inches long. Each of the central six head section cushions 180 preferably includes two distinct, independently controllable chambers 182, 184. First chamber 182 is that portion which will lie under, and which will support, the patient's head. First chamber 182 includes a coupling 186 to cooperatively engage a length of tubing extending to a manual release connector 102 coupled to support surface assembly 64 (for example, items 502, coupled to air channel 116 in FIG. 4), by which chamber 182 may be supplied with air.

Second chamber 184 will lie under the upper torso or shoulders of the patient. Cushion 180 includes a connector 100*b* to provide fluid communication between chamber 184 and a complementary connector member 100*a* on support plate assembly 64. (For example, items 504, coupled to air channel 120, for the center working cushion zone, in FIG. 4.) Cushion 180 will also preferably include a pair of baffles, 190, 192, respectively, one in each chamber 182, 184 to assist in maintaining the generally rectangular shape of cushion 180 during inflation. The outer two bolster head cushions will preferably each define only a single chamber.

Figure 9A:
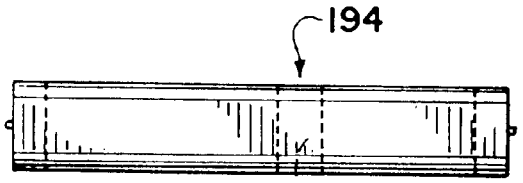
FIGS. 9A–D depicts a seat section working cushion of the support surface assembly of FIG. 3 illustrated with internal structure depicted in phantom lines; depicted in FIG. 9A from a top view; depicted in FIG. 9B from a side view; depicted in FIG. 9C from a bottom view; depicted in FIG. 9D from an end view.
Figure 9B:
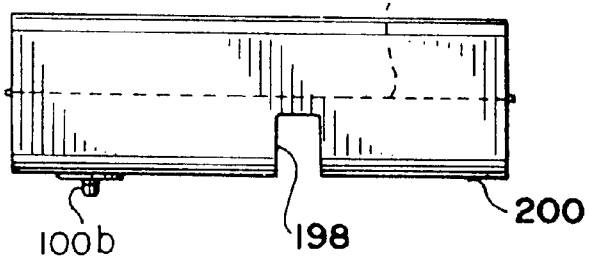
Figure 9C:
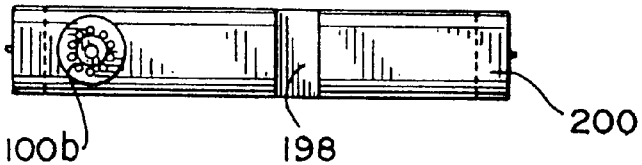
Figure 9D:
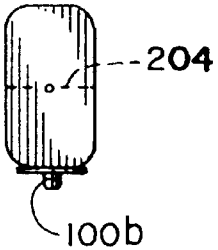

Referring now to FIGS. 9A–C, therein is depicted an exemplary seat working cushion 194 of group 80. Seat section working cushion 194 is preferably approximately 22.8 inches long. Each of the central six seat section cushions 194 includes a single quick disconnect connector member 100*b* to facilitate attachment of cushion 194 to support plate assembly 64 (see item 506 for the center working cushion zone, coupled to air channel 120, in FIG. 4). Seat section cushion 194 is a generally rectangular cushion which defines a single internal chamber. A notch, or relief, 198, however, is formed in lower surface 200 of cushion 194. When seat section cushion 194 is installed on support plate assembly 64, cushion 194 will extend across a central articulation point 202 of bed frame 26 (beneath flexible strip 74*b* in FIG. 3). Articulation of support plate assembly 64 at articulation point 202 will cause adjacent surfaces of support plate assembly 64 to move relative to one another. Notch 198 will accommodate such motion in support plate assembly 64 without placing unacceptable stress on cushion 194. Cushion 194 may also include one or more baffles 204 to facilitate the maintaining of the generally rectangular shape of cushion 204 during inflation.

Figure 10A:
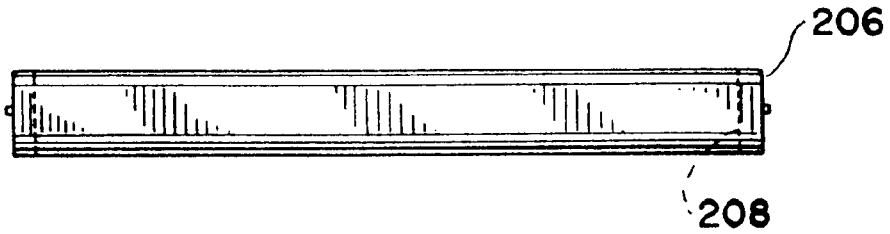
FIGS. 10A–C depicts a leg section working cushion of the support surface assembly of FIG. 3 illustrated with internal structure depicted in phantom lines; depicted in FIG. 10A from a top view; depicted in FIG. 10B from a side view; and depicted in FIG. 10C from a bottom view.
Figure 10B:
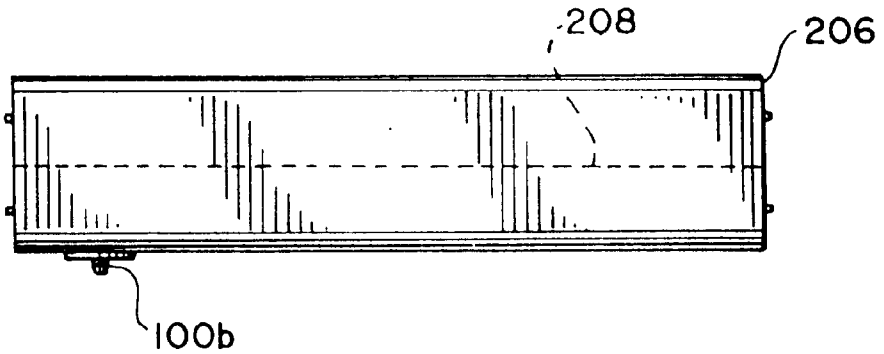
Figure 10C:
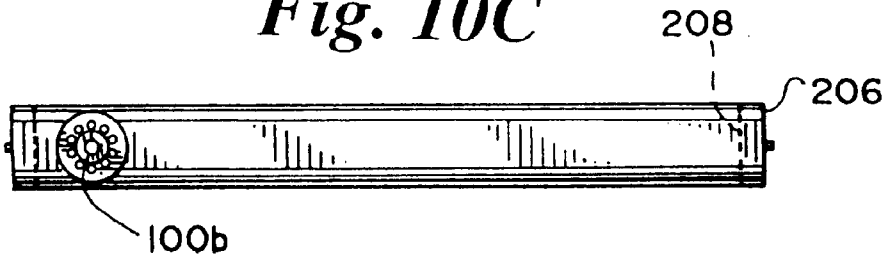

Referring now to FIGS. 10A–C, therein is depicted leg and foot cushion 206 of cushion 82. Leg and foot cushion 206 will preferably again be approximately 22.8 inches in length. and foot cushion 206 is a generally rectangular cushion defining a single chamber, and (for the six central cushions) having a quick disconnect connector member 100*b* (which may couple, for example, to item 508, for the center working cushion zone, and to air channel 120, in FIG. 4).

Figure 27A:
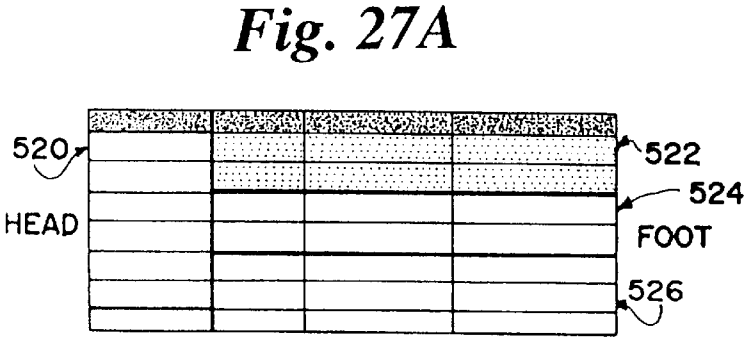
FIGS. 27A–B schematically depict the zones of the working cushions of FIG. 3, and the independently adjustable portions thereof.
Figure 27B:
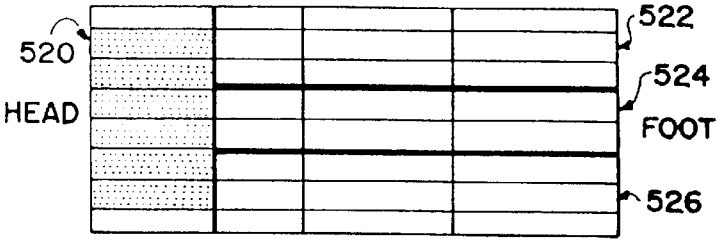

As will be apparent from the preceding discussion, considered in view of the schematic of FIG. 4, the working cushions of first inflatable layer 74 are divided into four distinct zones. These zones are depicted, for example, in FIGS. 27A–B, as head zone 520 (depicted in darkened fill-in FIG. 27B) left zone 522 (depicted in darkened fill-in 27A); center zone 524 and right zone 526. Through control of appropriate valves as indicated in FIG. 4, and thereby through control of air into air channels 110, 116, 120, and 128, the degree of inflation in each of these four zones may be regulated by control panel 36.

Referring again to FIG. 3, as previously discussed, bed 20 also includes a second, upper, inflatable level, indicated generally at 92. Second inflatable level 92 is preferably a multi-celled overlay assembly 94 which extends essentially the full length of first (lower) inflatable level 74. Lower and upper inflatable levels 74 and 92 will be held within a cover 95. Cover 95 will preferably be formed of a moisture vapor permeable fabric, such as that marketed under the trade name Dermaflex by Consoltex Inc., of New York, N.Y.

Figure 11:
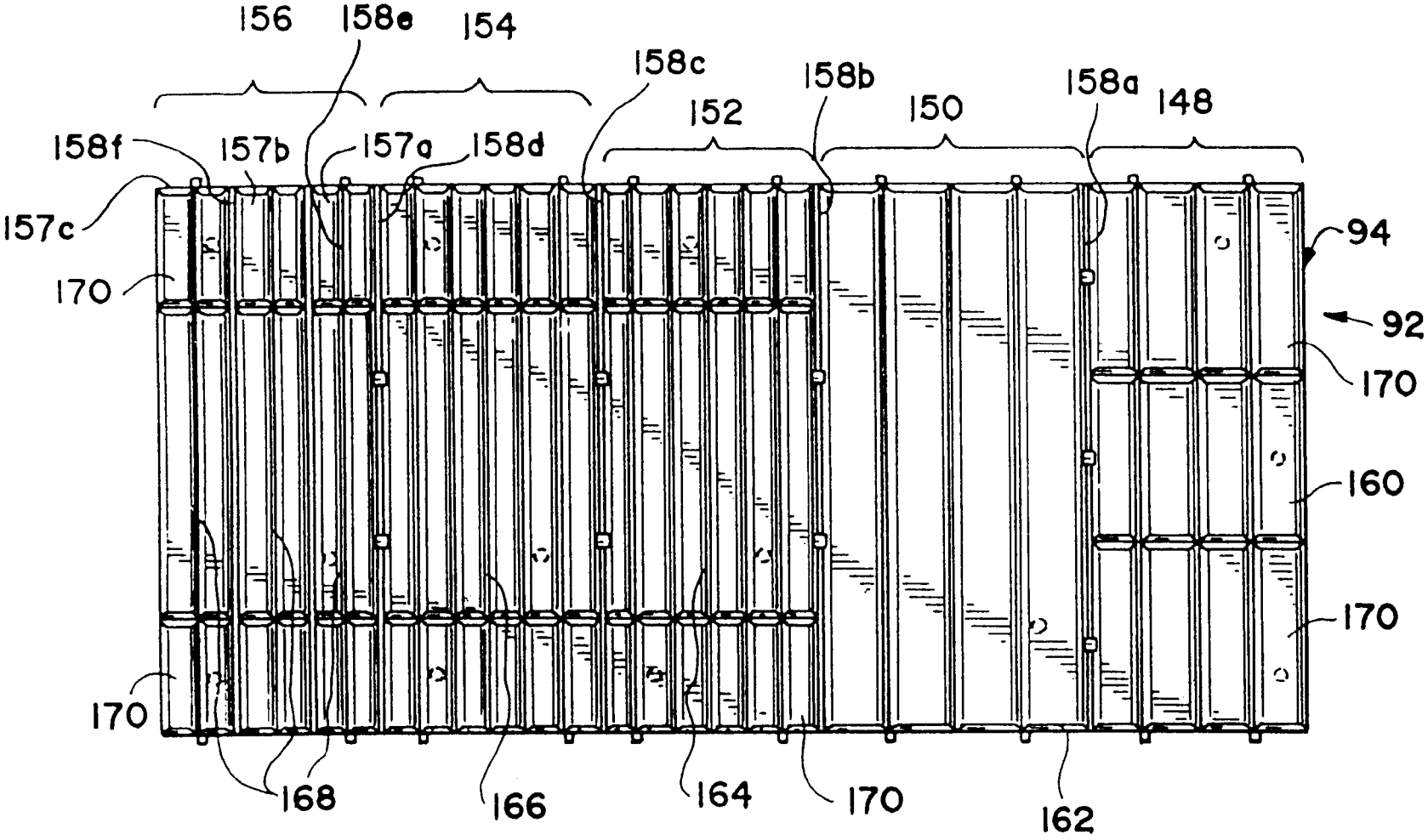
FIG. 11 depicts the overlay assembly of the support surface assembly of FIG. 3, illustrated from a top view.
Figures 12A, 12B, 12C, 12D:
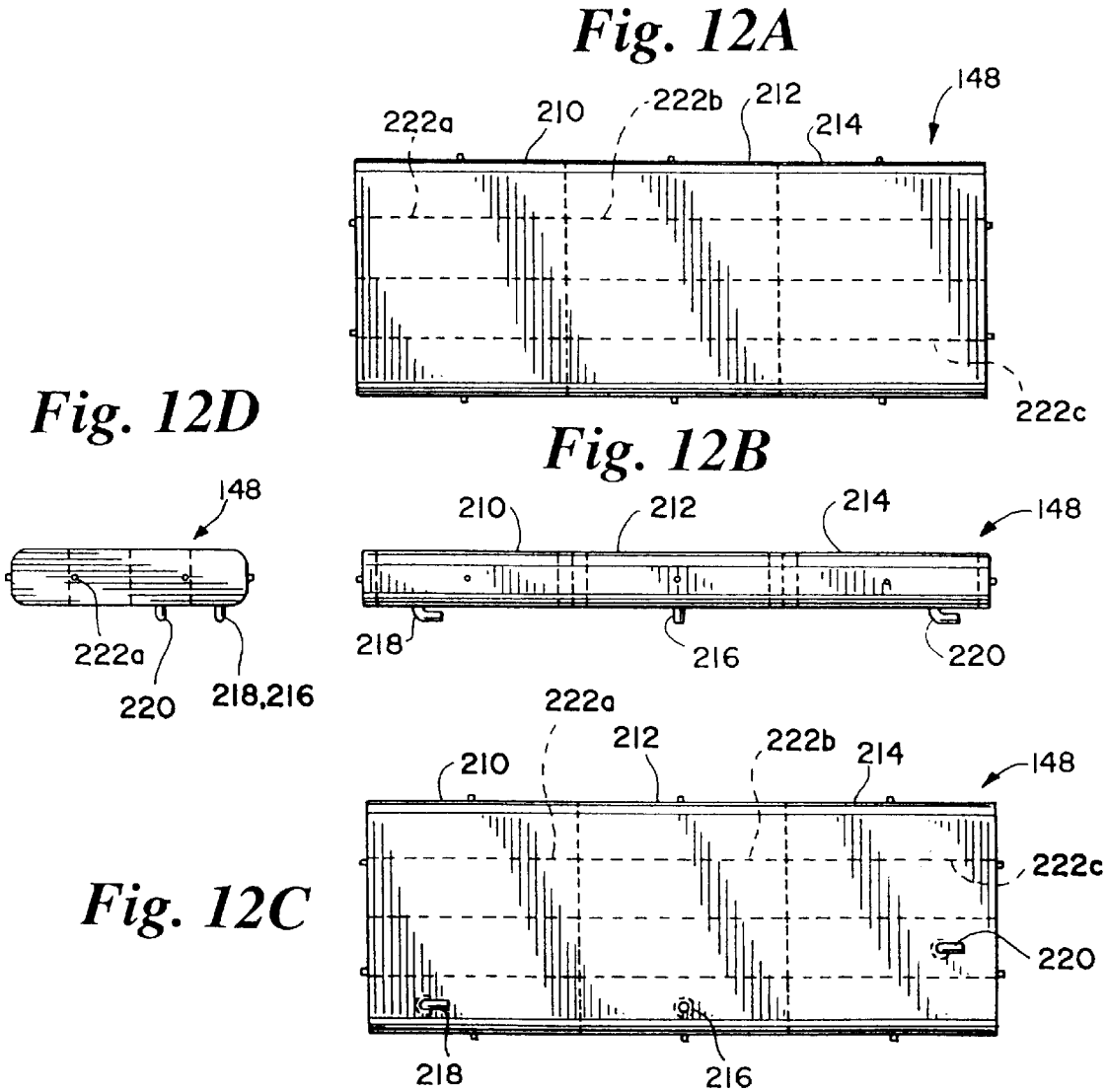
FIGS. 12A–D depict the head section of the overlay assembly of FIG. 11, illustrated with internal structure depicted in phantom lines; depicted in FIG. 12A from a top view; depicted in FIG. 12B from a side view; depicted in FIG. 12C from a bottom view; and depicted in FIG. 12D from an end view.

Referring now to FIG. 11, therein is depicted an exemplary embodiment of multi-section overlay assembly 94, forming upper inflatable section 92. Overlay assembly 94 may be constructed as a single unitary assembly. In a particularly preferred embodiment, however, overlay assembly 94 is formed of a plurality of, and most preferably of five, individual sections 148, 150, 152, 154, and 156; with section 156 formed of three distinct cushions 157*a*, 157*b*, and 157*c*. Adjacent sections 148, 150, 152, 154, and each cushion 157*a–c* of section 156 are preferably coupled together along transverse beads 158*a*, 158*b*, 158*c*, and 158*d* to form the complete assembly. The coupling of individual sections together is preferably through releasable coupling systems, such as the previously described snap fittings.

Figure 26A:
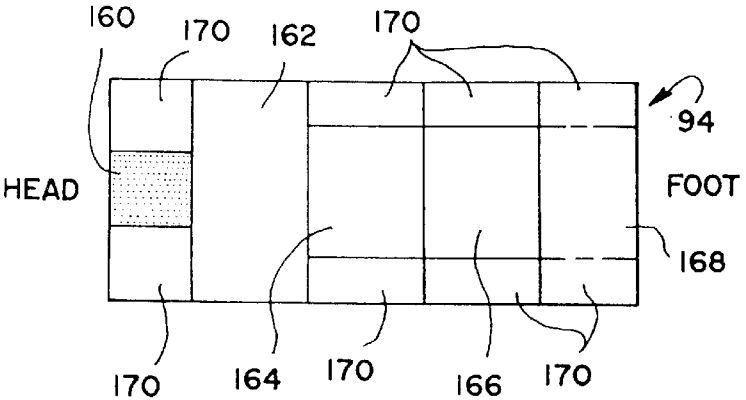
FIGS. 26A–B schematically depict the zones of the overlay assembly of FIG. 11, illustrating the independently controllable portions thereof.
Figure 26B:
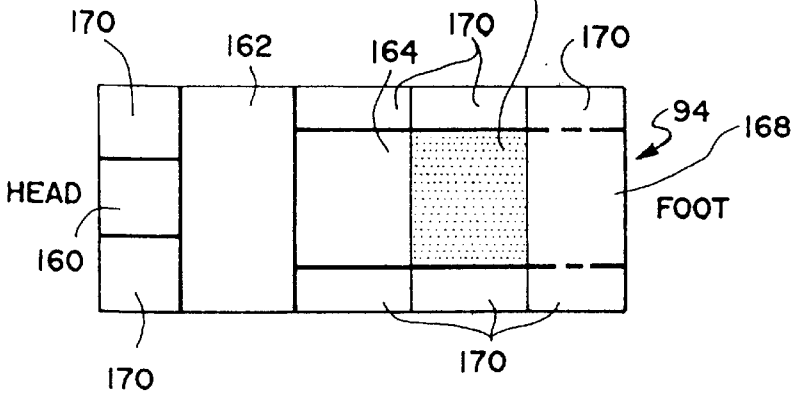

Referring now also to FIGS. 26A–B, overlay assembly 94 is utilized to provide primary control of patient comfort through control of interface pressures. Accordingly, overlay assembly 94 is preferably divided into six zones. A first, "head", zone, indicated generally at 160 (depicted in darkened fill in FIG. 26A), in first section 148 will support the patient's head.

A second "body" zone, indicated generally at 162, supports the patient's upper torso. Second zone 162 preferably includes a plurality of cells which may be [individually] controlled to provide percussion and vibration therapy to the patient, as described later herein. Preferably, second zone 162 will include at least four cells, each of which will preferably extend generally transversely under the patient's upper torso.

Overlay assembly 94 then includes three additional relatively central zones, a "seat" zone 164, a "thigh" zone 166, and a "foot" zone 168. An outer "bolster" or "cradle" zone 170 is intended to remain at relatively higher pressures than at least most of the above, relatively central, zones of overlay assembly 94, and to thereby form a cradle for the patient. This bolster zone 170 may extend along both sides of each of the previously discussed zones. Preferably, the outer zone will extend on each side of all zones except second "upper torso" zone 162, which will extend the full width of overlay assembly 92. This cradle serves to maintain the patient in optimally central location on bed 20. The cradle zone will also serve to maintain the patient generally centered during lateral rotation to thereby prevent the patient from slipping significantly to one side and to prevent the patient from contacting the bed siderails. In one preferred implementation the cradle zone will be maintained at a pressure approximately 2 inches of water higher than the pressure in seat zone 164. During rotation, the cradle pressure may be increased, such as to approximately twice the pressure in the seat zone, or alternatively to approximately manifold pressure.

Overlay assembly 94 is preferably constructed in a low air loss configuration, wherein selected positions of the upper surface provide for the dispersal of air through the surface. Preferably, the seat and thigh sections 152 and 154 of overlay assembly 94 will be constructed in this manner. A variety of constructions are known to the art for providing such air dispersal and for providing so-called "low air loss" support. In a preferred embodiment, the bags are constructed in a generally airtight manner, and include a plurality of apertures, such as pinholes, placed therein to provide the desired airflow.

Referring now to FIGS. 12A–D, therein is depicted head section 148 of overlay assembly 94. Head section 148 includes three laterally disposed chambers 210, 212, 214. Central chamber 212 is that section which will normally support the patient's head, and includes an air inlet 216 coupled to air channel 114 in support plate assembly 64 to facilitate independent control of the pressure in chamber 212. Air inlet 216 will preferably couple, for example, through a length of tubing to a manual release connector member 102*b* which will engage a complimentary connector member 102*a*, (identified as item 530 in FIG. 4). Outer head bolster chambers 210, 214 each include air inlets 218, 220 which couple in a similar manner to appropriate connectors 102*a* (see, for example, item 532 in FIG. 4), on support plate assembly 64 to couple to flow channel 124 provide lateral support for the patient's head. Each chamber 210, 212, 214 preferably includes a plurality of transversely extending internal baffles 222A, 222B, 222C in each chamber to maintain the shape of section 148 during inflation.

Figure 13A:
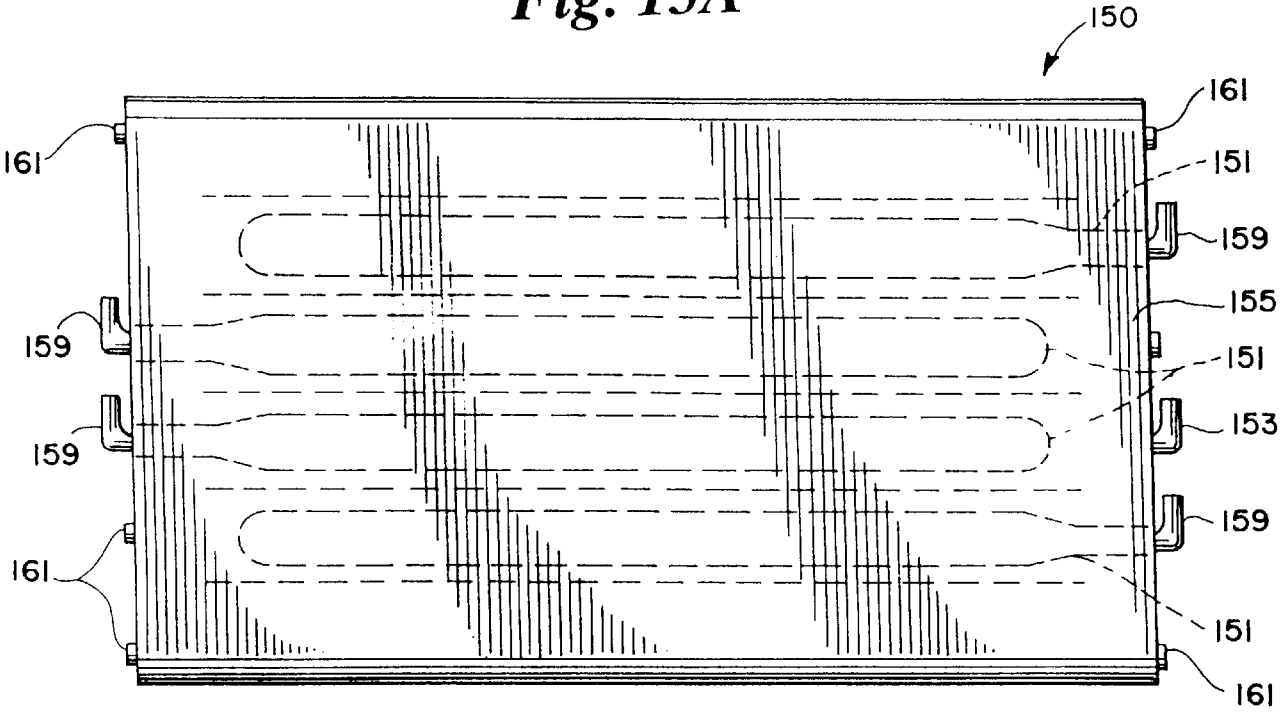
FIGS. 13A–C depict the chest section of the overlay assembly of FIG. 11, depicted in FIG. 13A from a top view and depicting internal cells; and depicted in FIGS. 13B and C from opposing side views.
Figure 13C:
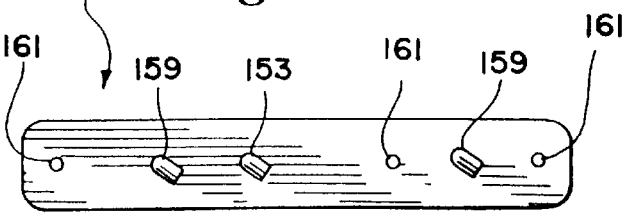
Figure 13B:
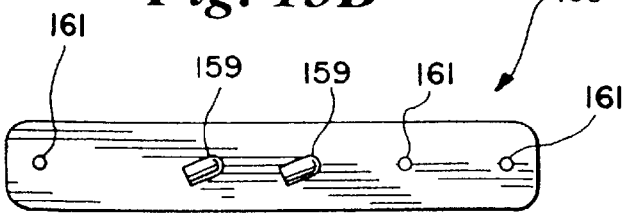
Figure 14A:
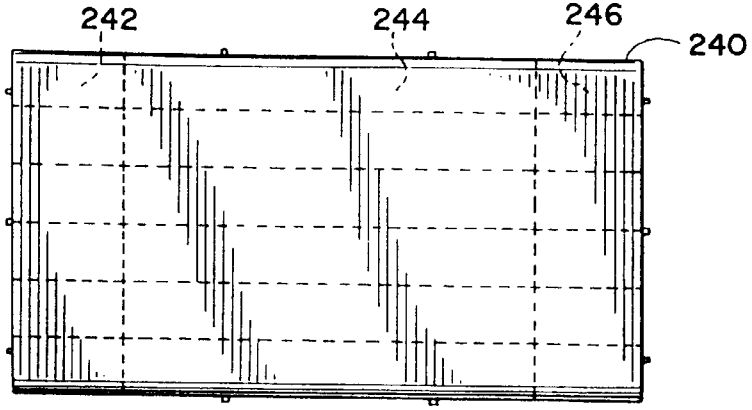
FIGS. 14A–D depict a section of the overlay assembly of FIG. 11 as is used with the seat or thigh sections, illustrated with internal structure depicted in phantom lines; depicted in FIG. 14A from a top view; depicted in FIG. 14B from a side view; depicted in FIG. 14C from a bottom view; and depicted in FIG. 14D from an end view.
Figure 14B:
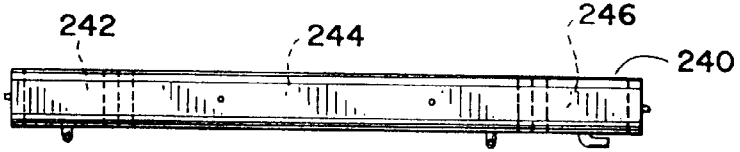
Figure 14C:
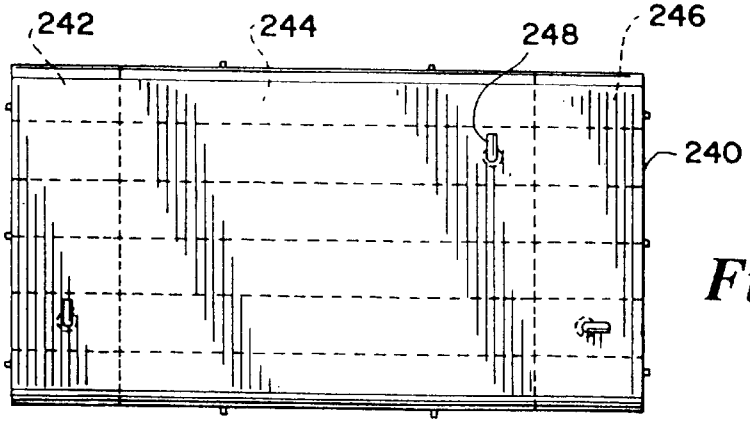
Figure 14D:
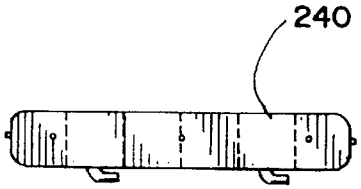
Figure 15D:
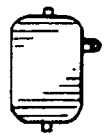
FIGS. 15A–D depict a cushion as is used in combination to form the foot section of the overlay assembly of FIG. 11; depicted with internal structure depicted in phantom lines; depicted in FIG. 15A from a top view; depicted in FIG. 15B from a side view; depicted in FIG. 15C from a bottom view; and depicted in FIG. 15D from an end view.
Figure 15A:
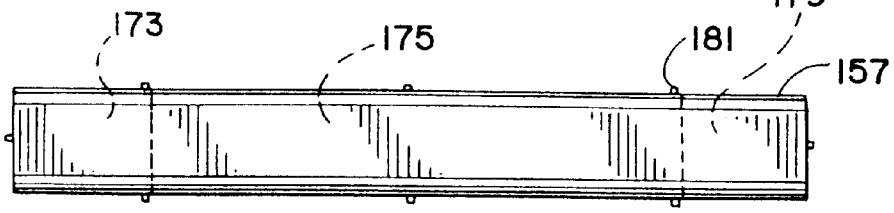
Figure 15B:
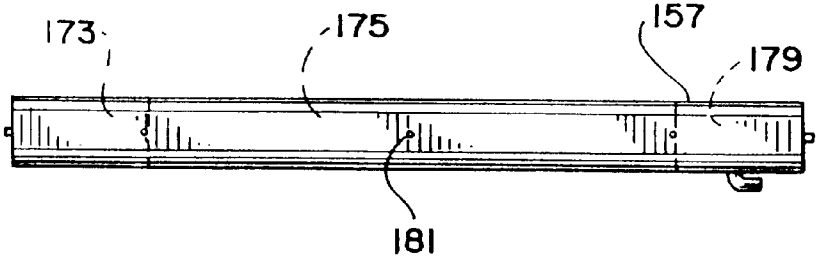
Figure 15C:
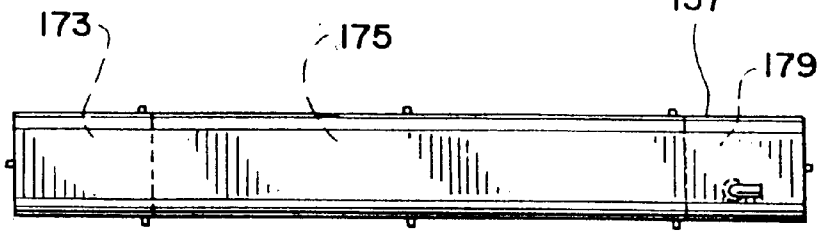

Referring now to FIGS. 13A–C, therein is depicted torso section 150 of overlay assembly 94. Torso section 150 includes a plurality, and preferably four, internal tubes or cells 151 extending generally across the width of torso section 150. All four tubes are housed within the larger inflatable envelope 155 of torso section 150. Each tube 151 is coupled to a connector 159 to facilitate coupling of the tube to a connector 102*a* on support plate 64. Torso section 150 is that section which will provide percussion and vibration therapy to the patient through selective rapid inflation of each cell 151. Torso section 150 includes a plurality of snaps to engage complimentary snaps 161 on adjacent sections. Section 150 also includes a coupling 153 to couple envelope 155, through tubing, to a connector member 102*b*. (Such connector will couple, for example, to a complimentary connector as indicated at 533 in FIG. 4).

Referring now to FIGS. 14A–D, therein is shown a section of overlay assembly 94 as may be utilized for either of sections 152 or 154 for the seat and thigh portions of the patient's body, respectively. Each section 240 is divided into three distinct chambers 242, 244, and 246. As previously described, outer chambers 242 and 246 serve as bolsters to assist in retaining a patient centralized upon overlay assembly 94. Central chamber 244 is independently adjustable in pressure through an inlet 248 to establish optimal comfort and/or interface pressures for the patient.

Referring now to FIGS. 15A–D, therein is depicted an exemplary cushion 157 as is used, in a set of three, to form foot section 156 of overlay 94. Each cushion 157 includes three chambers 173, 175, and 179. Outer chamber 173 and 179 form bolster chambers, while central chamber 175 will support the patient's feet. Each cushion 157 includes a plurality of snaps by which the cushion will couple to an adjacent cushion or section, or the fabric panel 90. Each chamber includes a connector to facilitate fluid couping the support plate 64 in the manner previously described.

The use of separate cushion to support the patient's feet allows the feet to slip between the cushions to avoid localization of pressure on the back of the heel by allowing substantial support of the foot to come from the support of the bottom of the foot on a cushion; thereby reducing the likelihood of breakdown of the patient's skin.

Figure 29:
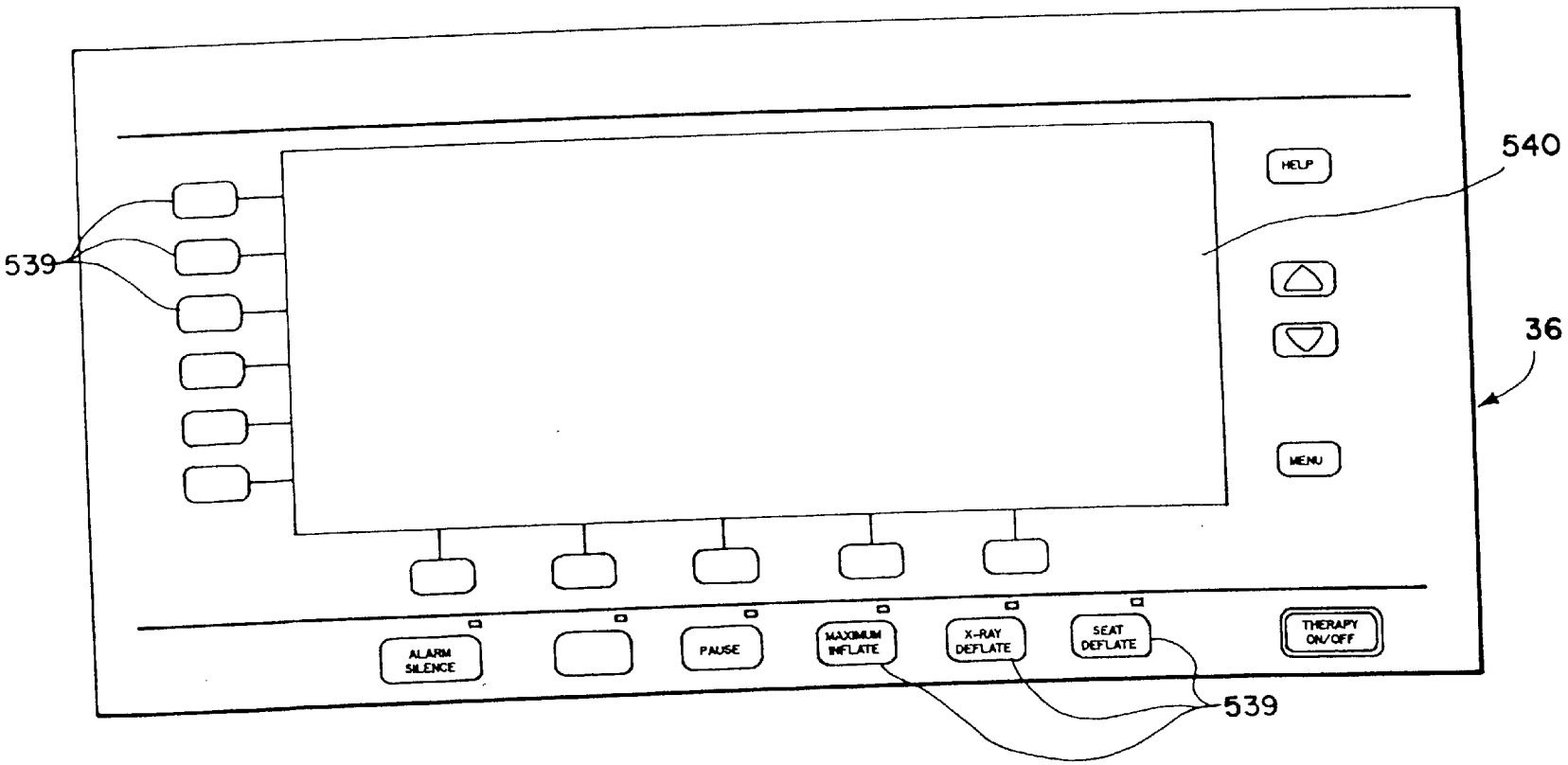
FIG. 29 depicts a front view of an exemplary control panel useful with the bed of FIG. 1.

Referring now to FIG. 29, as stated previously, bed 20 is controlled through use of control panel 36 including a liquid crystal display 540 accompanied by a plurality of touch-sensitive membrane switches 539. Switches 539 provide the data input medium for the microprocessor in control panel 36 controlling the functions of bed 20. In one preferred implementation of the invention, control panel 36 includes a 32 bit Motorola 68331 microprocessor to control functions of bed 20. Bed operating parameters are preferably contained within a 1 or 4 Mbit EPROM to facilitate program changes. A real time clock module provides time and date for software functions and preferably includes 114 bytes of non-volatile RAM for maintaining selected control panel data when power is removed.

Figure 16:
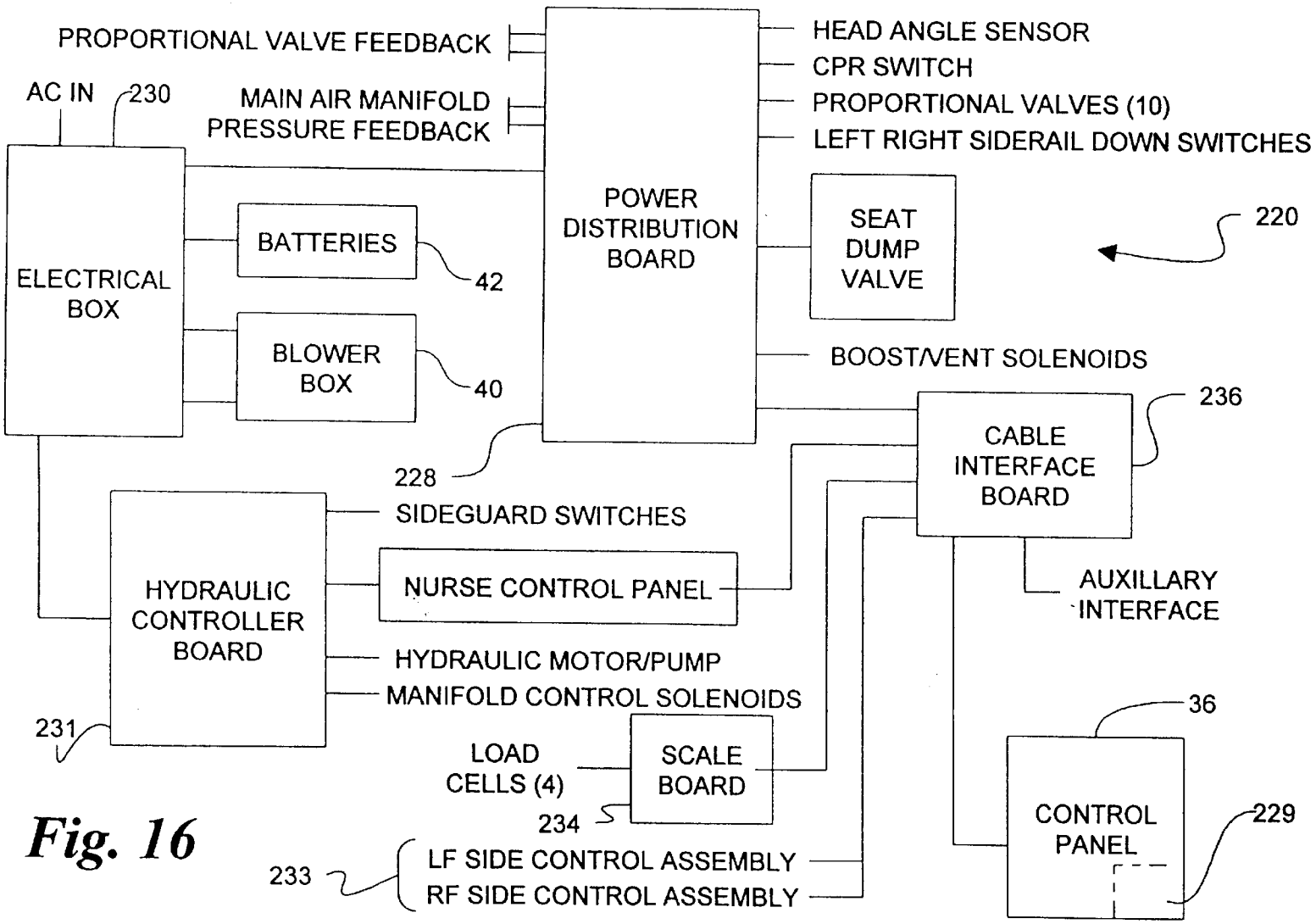
FIG. 16 schematically depicts an exemplary electrical control circuit useful with the bed of FIG. 1.

Referring now to FIG. 16, therein is depicted a block diagram of the electrical system 220 of bed 20. Electrical system 220 includes control panel 36 as previously described. A power distribution board 228 provides an interface between control panel 36 and other control devices, including: the proportional valves 50 controlling airflow to each channel in the bed, a seat dump valve (described in reference to FIGS. 28A–C); pressure transducers; blower; side guard position switches, head elevation sensors, and various other functions. To provide this interface, power distribution board 228 includes a microcontroller. Pressure feedback tubes (56*a–j* in FIG. 7) couple to pressure transducers on power distribution board 228 to facilitate monitoring and precise control of air pressures in cells in upper inflatable level 92 and lower inflatable level 74. In addition to the proportional valve feedback, as previously described feedback of the main air pressure manifold is communicated to power distribution board 228 through a pressure feedback tube (56*k* in FIG. 7), to facilitate control of blower 40. Some input signals to power distribution board are voltages which are then each converted to a digital signal and communicated to the microcontroller on the power distribution board 228. Similarly, a digital to analog converter on the power distribution board receives digital signals from control panel 36 (and in particular from microprocessor 229 therein), and converts the signals into analog voltages to establish parameters, such as, for example, the proportional valve position (and resulting pressure output), and the blower speed.

Electrical box 230 receives input AC power and communicates that power both to the hydraulic controller circuitry which controls hydraulic functions of the bed, and also provides 24 to 27 volt DC current to operate blower 40, a cooling fan, and further to voltage reducers providing 12 and 5 volts DC current for operation of electronics in bed 20. A scale board 234 interfaces with a plurality of load cells (preferably 4 load cells) on bed 20 to facilitate monitoring a patient's weight. Cable interface board 236 provides a junction point for cables to interconnect the various control unit components, including those of the bed frame 26, itself (see 231, 233).

Figure 17:
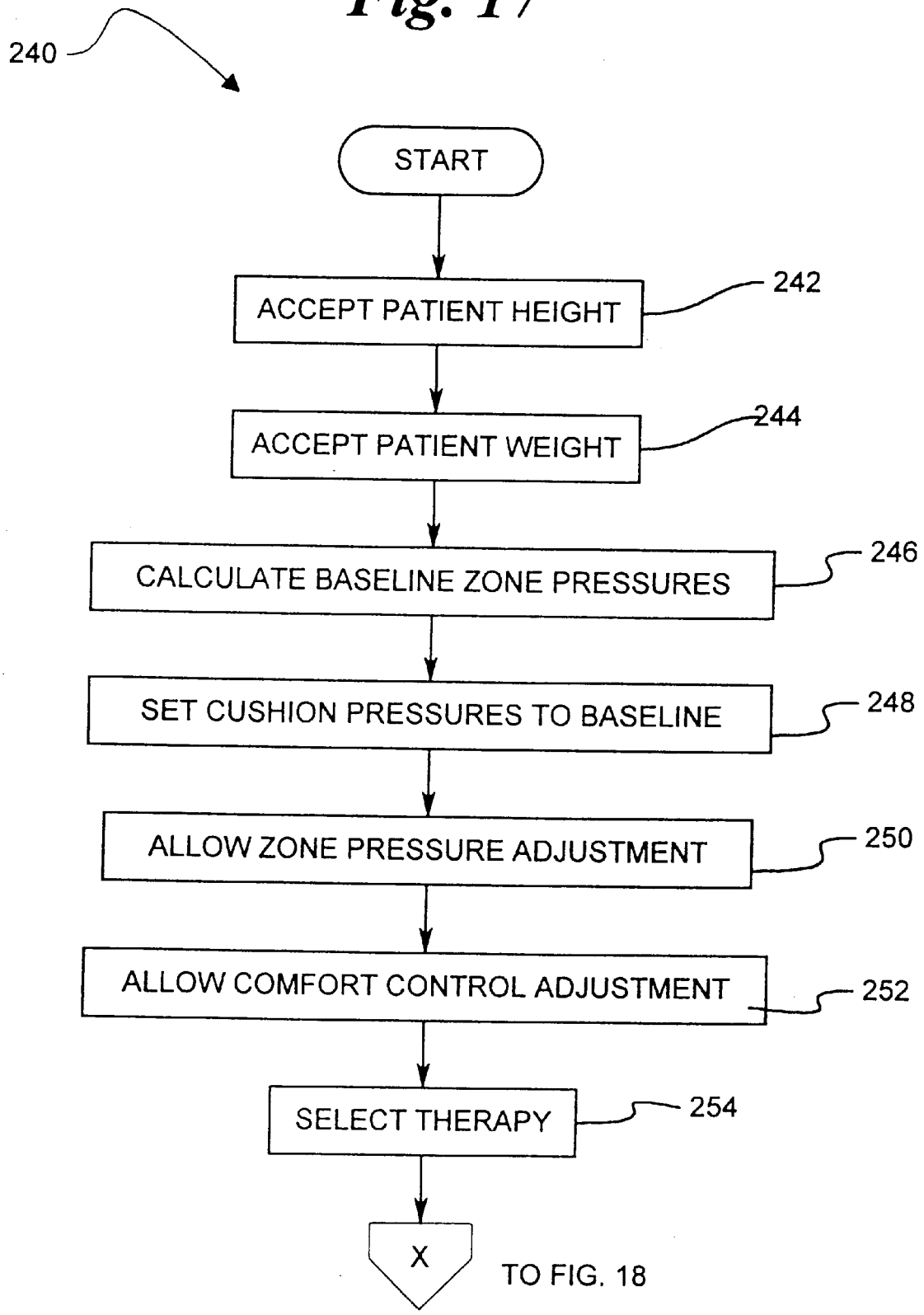
FIG. 17 depicts an exemplary flowchart for the patient pressure baseline setup routine for a bed in accordance with the present invention.
Figure 19A:
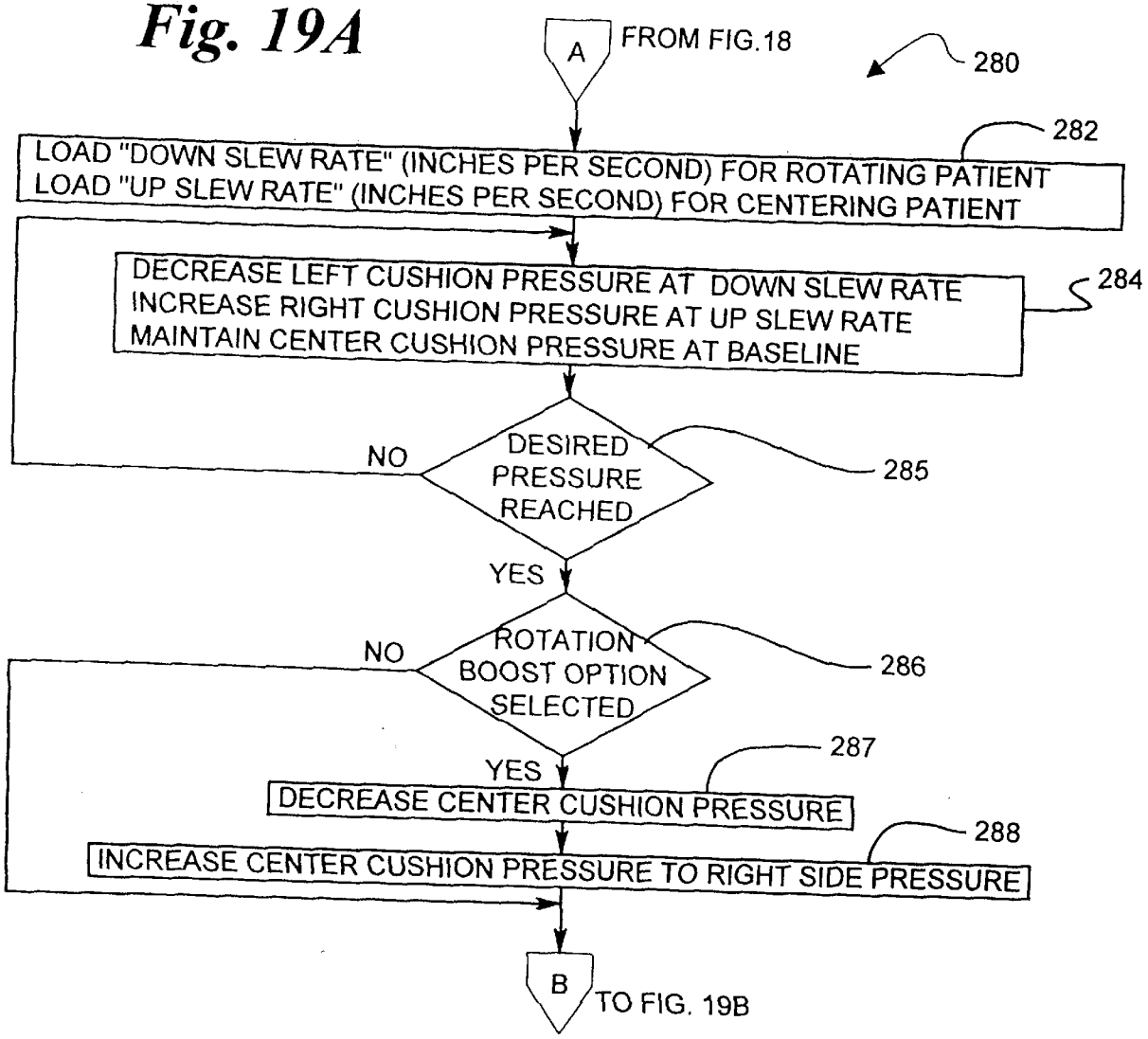
FIGS. 19A–F depict an exemplary flowchart for the implementation of rotation therapy in a bed in accordance with the present invention.
Figure 19B:
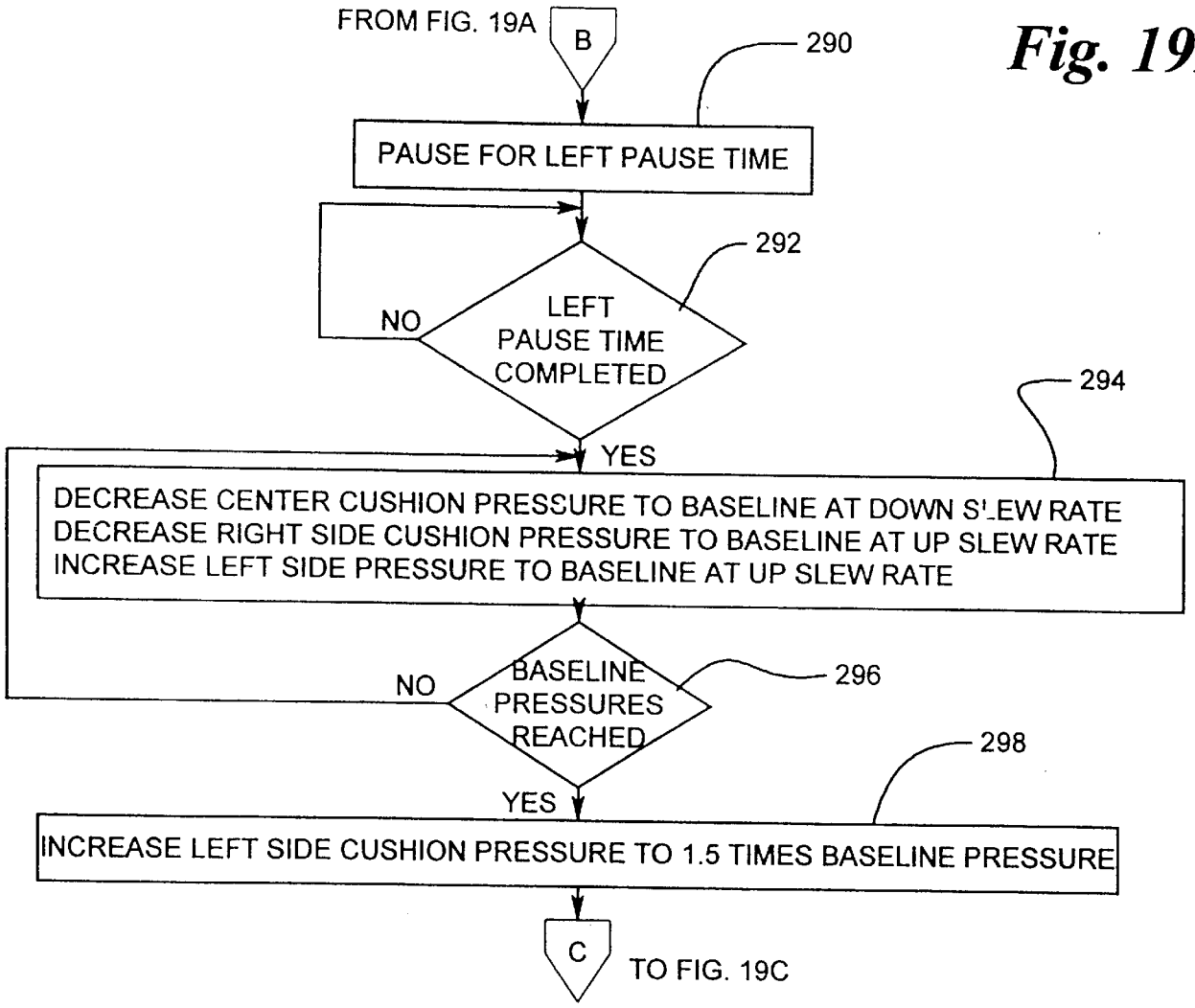
Figure 19C:
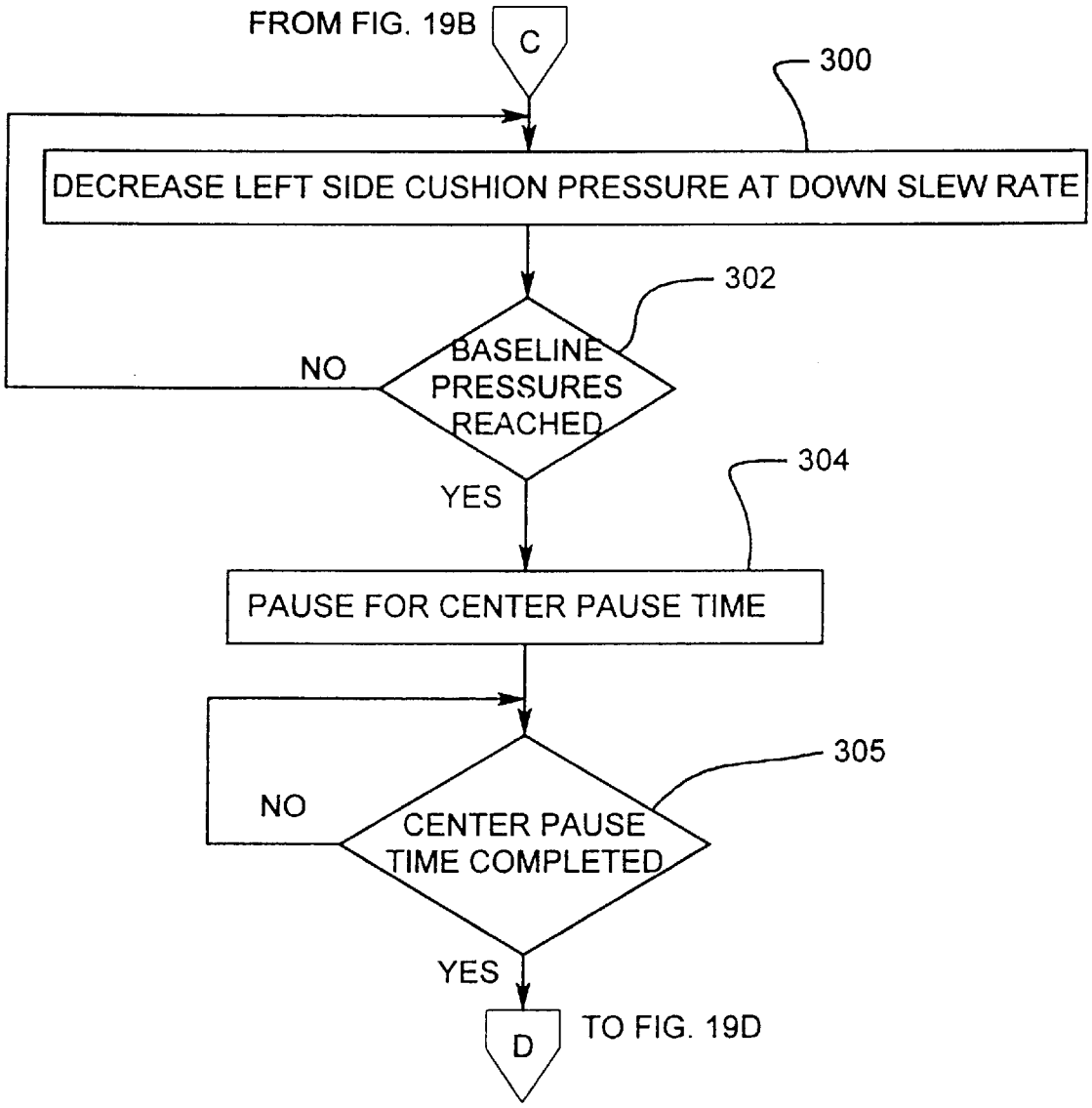
Figure 19D:
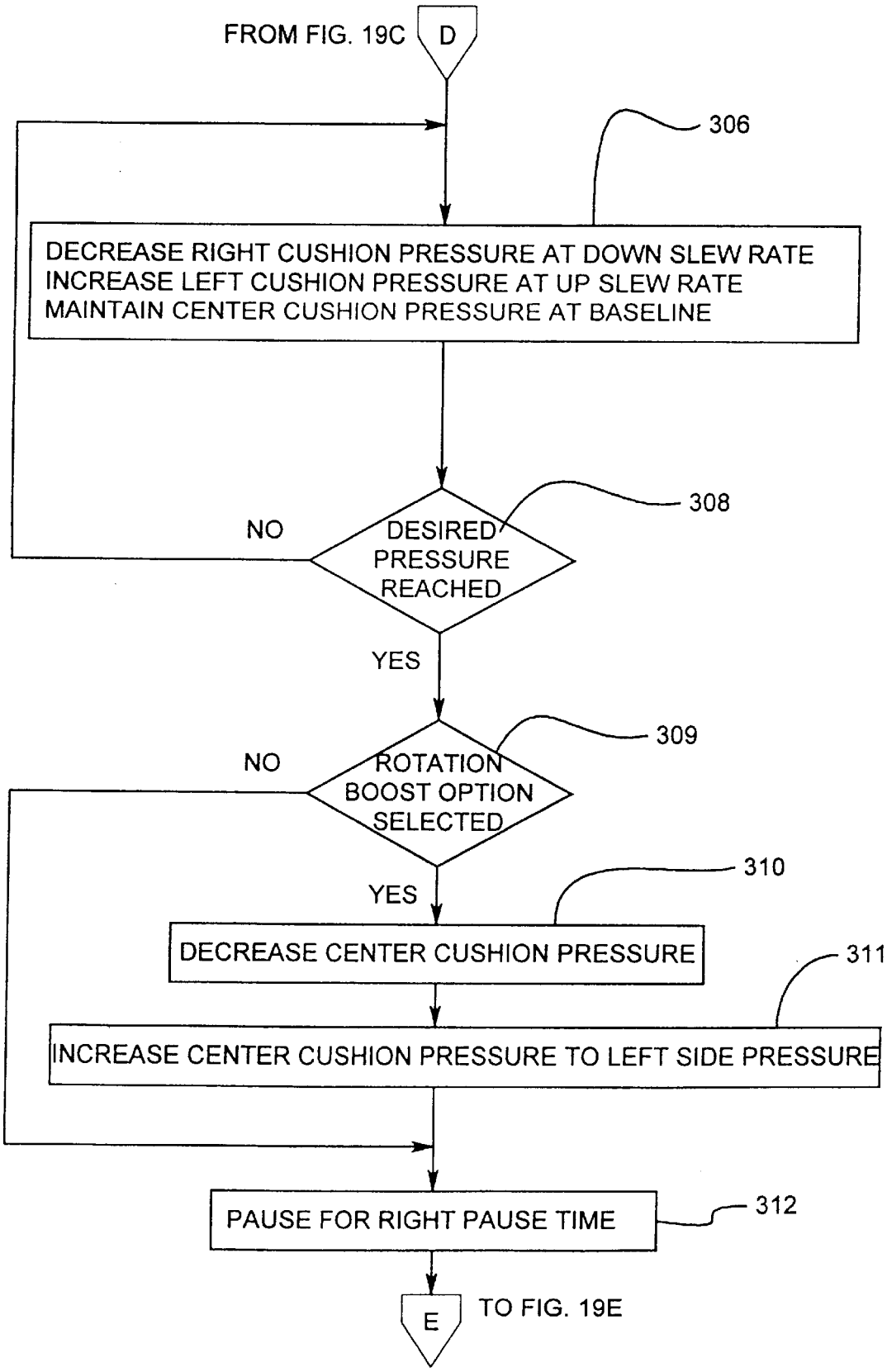
Figure 19E:
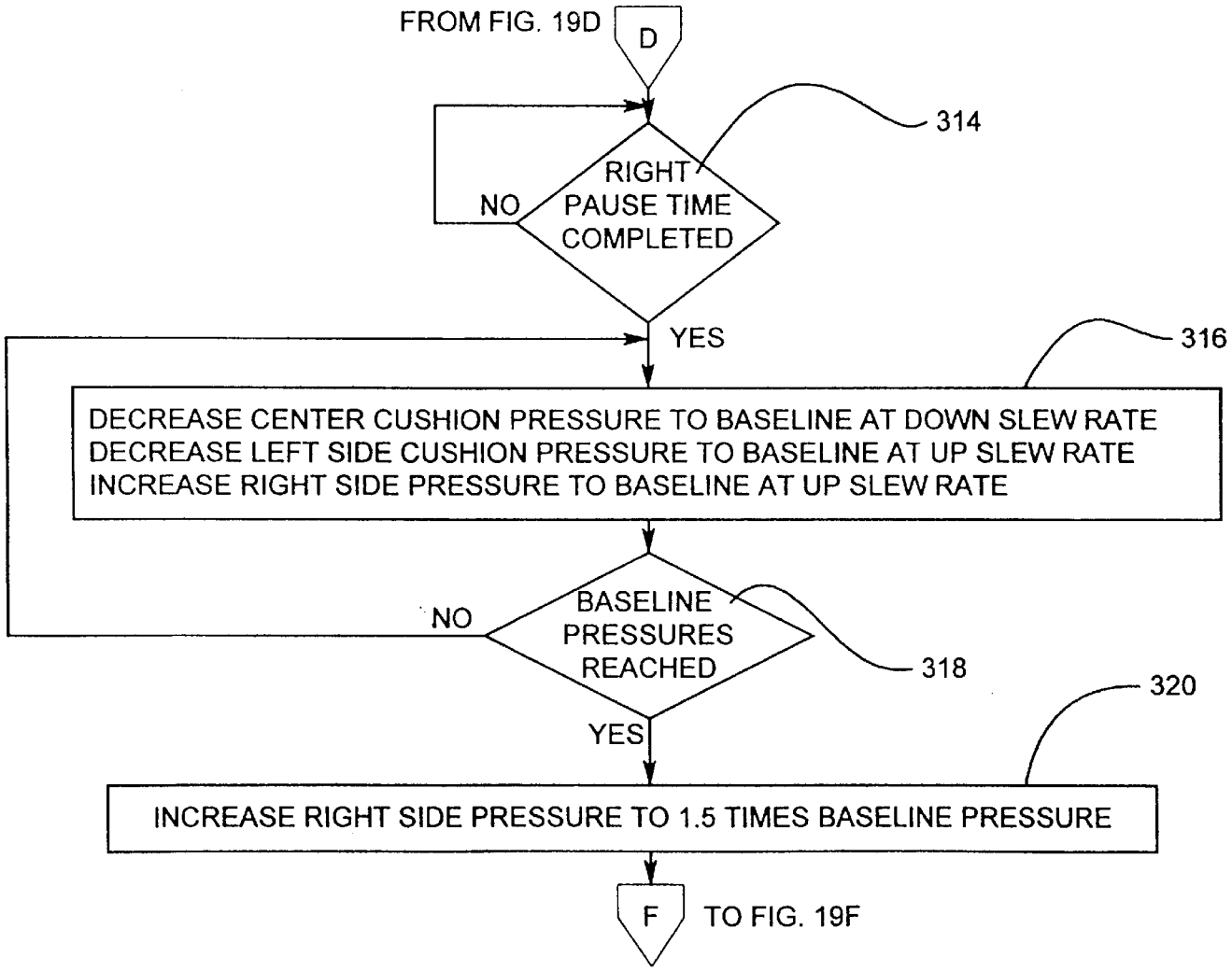
Figure 19F:
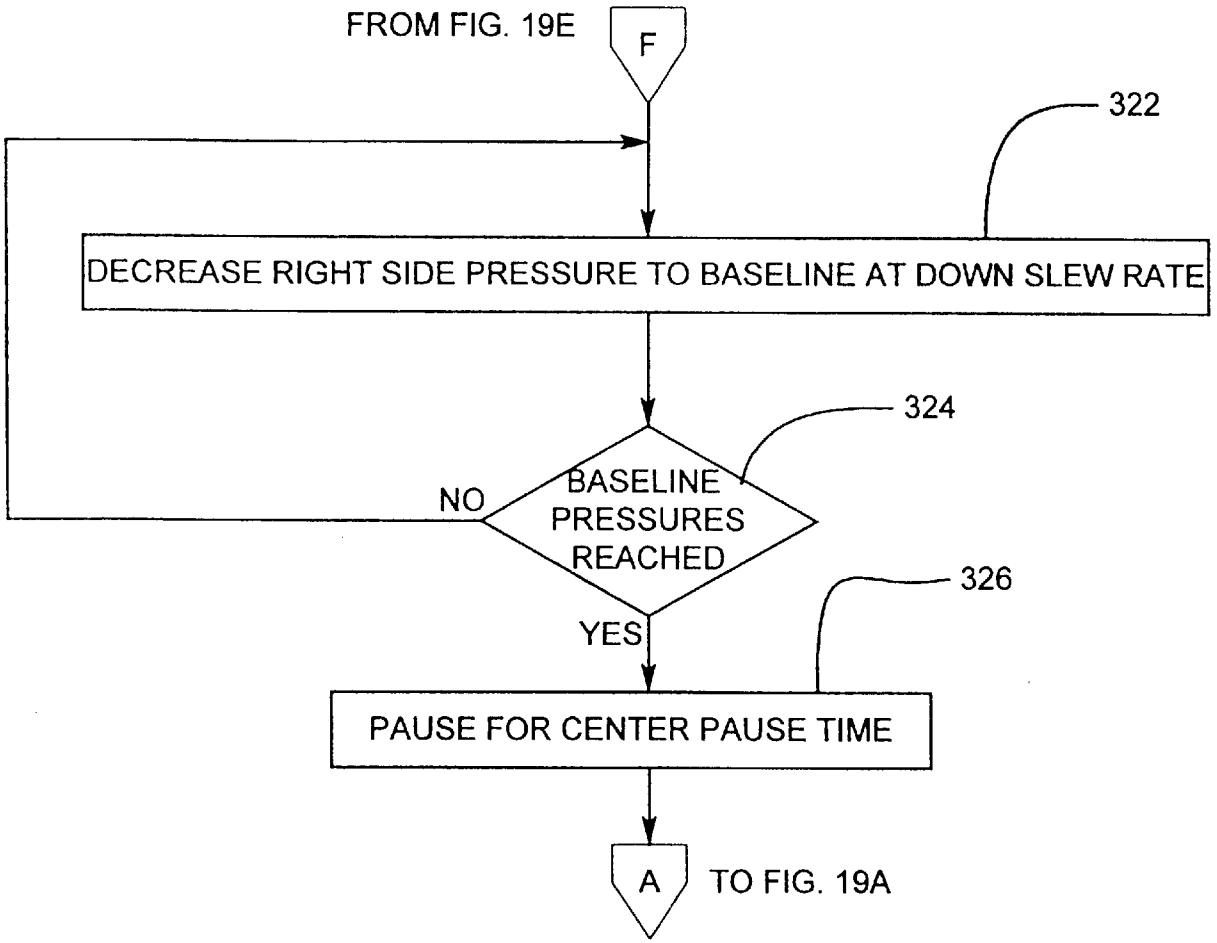

Referring now to FIG. 17, therein is depicted a flowchart 240 of the patient pressure baseline setup routine implemented trough control panel 36 by the microprocessor 229 therein. As can be seen, to ready the bed for a particular patient, inputs will be provided for the patient's height 242 and weight 244. Based upon such inputs, control panel 36 determines initial baseline zone pressures 246 for the working cushions of lower support layer 74 and for overlay assembly 92, based upon predetermined criteria. Such criteria are well-known in the industry, and are a matter of design choice. Once the predetermined baseline pressures are established, in each zone the pressure may be varied by the caregiver to define a pressure baseline specifically tailored to the individual patient. Typically, pressures of the working cushions will be equal within each cushion group 78, 80, 82; and will typically range between 0 and 20 inches of water. Each of the preestablished zones in upper overlay assembly 94 will be adjusted to provide optimal interface pressure and patient comfort. To achieve this, once predetermined baseline pressures are determined 246, for each zone and control panel 36 will communicate, through power distribution board 228 to operate proportional valves 50 to establish all cushion pressures at the predetermined baseline level 248. At such time, the pressures may be individually customized through control panel 36 to vary pressures in individual zones 250, or to adjust zone levels as necessary to achieve optimal patient comfort 252. Once setup has been completed, any desired therapy may be selected 254.

Referring now to FIG. 18, therein is depicted a flowchart for blower pressure setup routine 256. Where a therapy other than static support is selected for the patient, control panel 36 will adjust the blower pressure as appropriate. As can be seen in FIG. 18, when rotation therapy is selected 258, the blower pressure will be established to eight inches of water above the maximum zone pressure established during the setup procedure 240. However, if relaxation therapy is selected 262 then the blower pressure will be established to six inches of above the maximum zone pressure established 264 during setup 240. Where vibration therapy is selected 266, percussion therapy is selected 268, or a combination of vibration and percussion therapy is selected 274, then in each circumstance, the blower pressure will be established to eight inches of water above the maximum zone pressure, 270, 272, respectively. In the absence of any therapy being selected 276, then the blower pressure will be merely established to six inches of water above the maximum zone pressure and such level will be maintained during standard mode therapy 278.

Referring now to FIGS. 19A–F, therein is depicted flowchart of an exemplary rotation routine 280 for controlling rotation of a patient on bed 20. Where rotation therapy was selected (see FIG. 17) and the blower has been appropriately established (see FIG. 18), then determined parameters regarding the speed of rotation in both a downward direction ("down slew rate") and an upward direction ("up slew rate") will be loaded 282 from predetermined data based on the patient's height and weight. In one preferred embodiment, the down slew rate will be approximately 0.5 inch of water/second; while the up slew rate will be approximately 0.1 inch of water/second. Subsequently, rotation of the patient to the left side will be initiated by decreasing the left working cushion pressure at the down slew rate, and by increasing the right cushion pressure at the same "up slew rate" while maintaining center cushion pressure at baseline 284. During these changes, the pressures of overlay assembly 94 will remain essentially constant, while the pressures extending longitudinally down the entire length of the working cushions will preferably be varied at the preselected uniform rate. These changes will continue until a selected lower pressure is reached 285 in the (decreased pressure) left cushions. A determination is made if the rotation boost option has been selected 286. If so, the center cushion pressure will be decreased 287 for a predetermined period, for example, fifteen seconds. The center cushion pressure will then be increased to equal that of the right side pressure 288 to complete rotation of the patient. Once the center working cushion pressure is equal to that of the right working cushion pressure, a pause is preferably included to allow the patient to remain in such position for a preestablished period of time 290. After the expiration of the predetermined pause period is determined 292, then control panel 36 initiates functions to center the patient, or to return the patient to a generally horizontal position. This function occurs: (1) by decreasing the center cushion pressure to the established baseline pressure at the predetermined "down slew rate"; (2) by decreasing the right side working cushion pressure to the established baseline at the up slew rate; and (3) by increasing the left side working cushion pressure to the established baseline at the up slew rate 294. Once the baseline pressures are reached 296, then the left side working cushion pressure will be increased to 1.5 times the baseline pressure 298; and will subsequently then be decreased 300 until the left side working cushion pressure is again at the determined baseline 302, thereby establishing true horizontal positioning of the patient. Again, a pause will preferably be effected 304 to maintain the patient in the horizontal position for a predetermined time period. Once the predetermined pause time 304 has expired 305, then rotation of the patient to the right side will be initiated. This is done by decreasing the right working cushion pressure at the down slew rate while increasing the left working cushion pressure at the up slew rate while maintaining the center cushion pressure at baseline 306. Once the desired pressure is reached in right working cushion 308 then a determination is again made if the rotation boost option has been selected 309. If so, the center working cushion pressure will be decreased for a selected time period 310, and will then be increased in pressure to match that of left working cushion pressure 311, thereby completing rotation, and pausing for a predetermined period 312. Once the pause time has expired 314 the process will begin to again center the patient by decreasing the center working cushion and the left working cushion pressure to baseline at the down slew rate and the up slew rate, respectively, while increasing the right working cushion pressure to baseline at the up slew rate 316. Once the baseline pressures are reached 318, then the right side working cushion pressure will be increased to 1.5 times the baseline pressure 320 and then be decreased 322 until the baseline pressure is reached 324, and a pause will then again be initiated at the center position 326.

Figure 20:
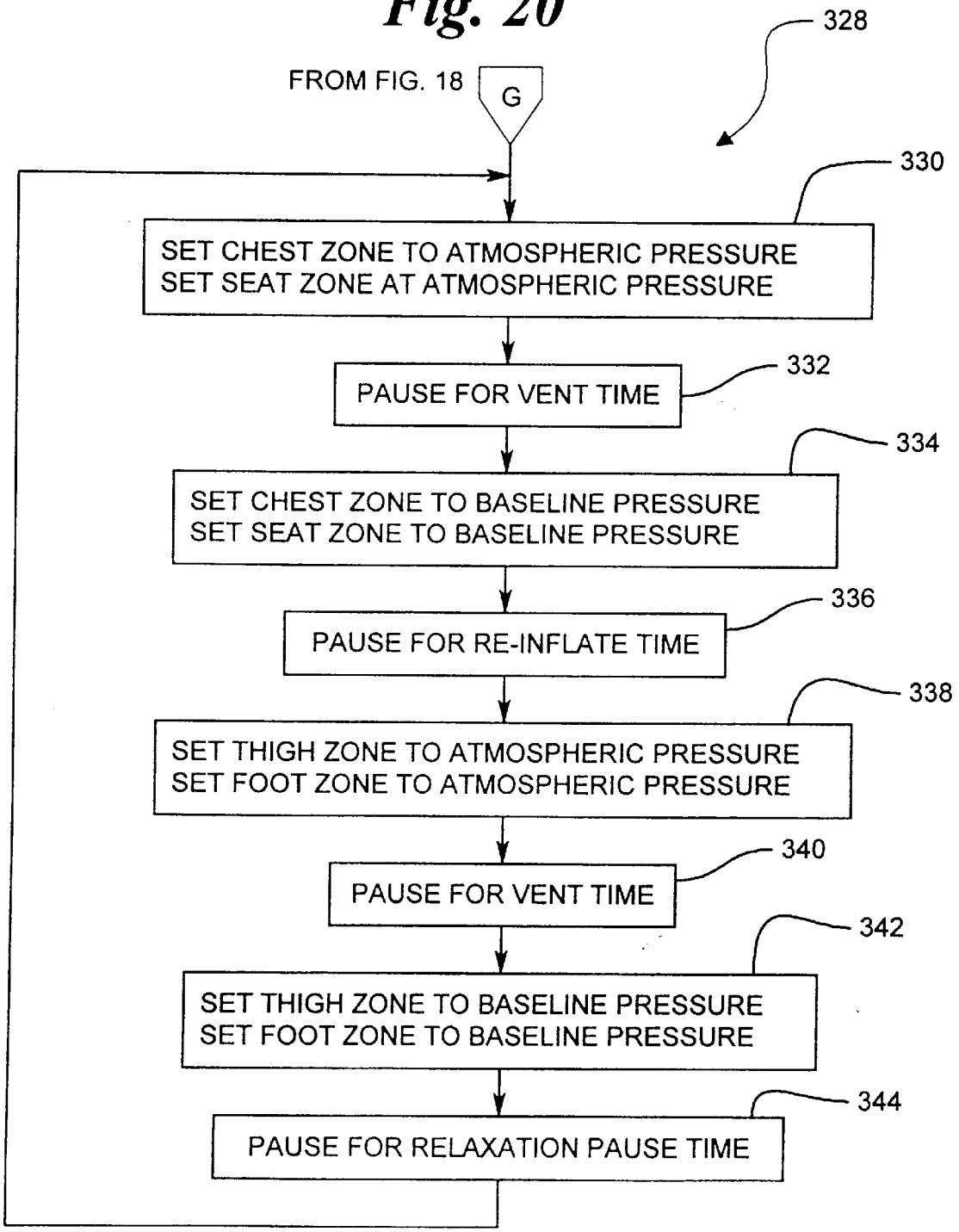
FIG. 20 depicts an exemplary flowchart for implementation of pressure relief, or "relaxation", therapy for a bed in accordance with the present invention.

Referring now to FIG. 20, therein is depicted a flowchart for a relaxation, or pressure relief, therapy routine 328. Relaxation therapy will function by changing pressures within entire zones within overlay assembly 94. When relaxation mode is entered, the chest zone and the seat zone will each be set to Atmospheric pressure 330. After a pause for a predetermined time period, preferably 30 seconds, 332; the chest zone and the seat zone will be returned to baseline pressure 334. After another pause, again preferably for 30 seconds, 336, the thigh zone and the foot zone will be decreased to atmospheric pressure 338. After another pause, again preferably for 30 seconds, 340; the thigh zone and foot zone will be returned to baseline pressure 342 and another pause will be initiated 344.

Figure 21:
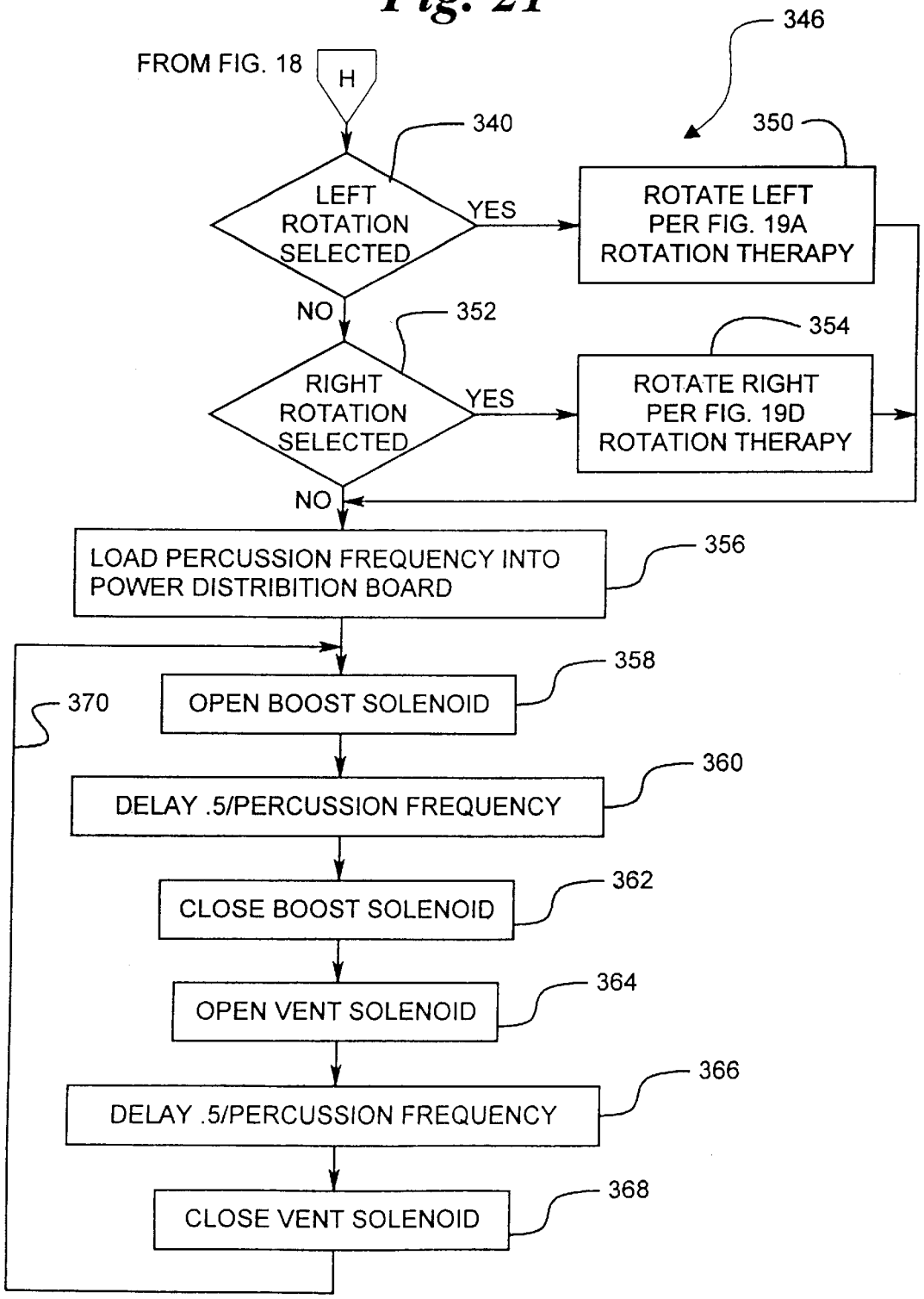
FIG. 21 depicts an exemplary flowchart for implementation of percussion therapy for a bed in accordance with the present invention.

Referring now to FIG. 21, therein is depicted a flowchart for an exemplary routine for implementation of percussion therapy 346. In the percussion therapy routine, determination is first made as to whether left rotation was selected 348. If left rotation was selected, then the patient is rotated to the left in accordance with the flowchart of FIG. 18A. Alternatively, if it is determined that right rotation was selected 350, then the patient is rotated to the right in accordance with FIG. 18C. Alternatively, of course, the patient may be merely retained in a horizontal position. Once the patient is in the desired position, the operator selected percussion frequency is input 356. The boost solenoid (480 in FIG. 31) is then opened 358, and after a delay of one half of the preselected percussion frequency 360, the boost solenoid will be closed 362. The vent solenoid (481 in FIG. 31) will then be opened, and after again a delay of one half of the preselected percussion frequency, the vent solenoid will be closed. The sequence will then be repeated 370 for the desired duration of the percussion therapy.

Figure 22:
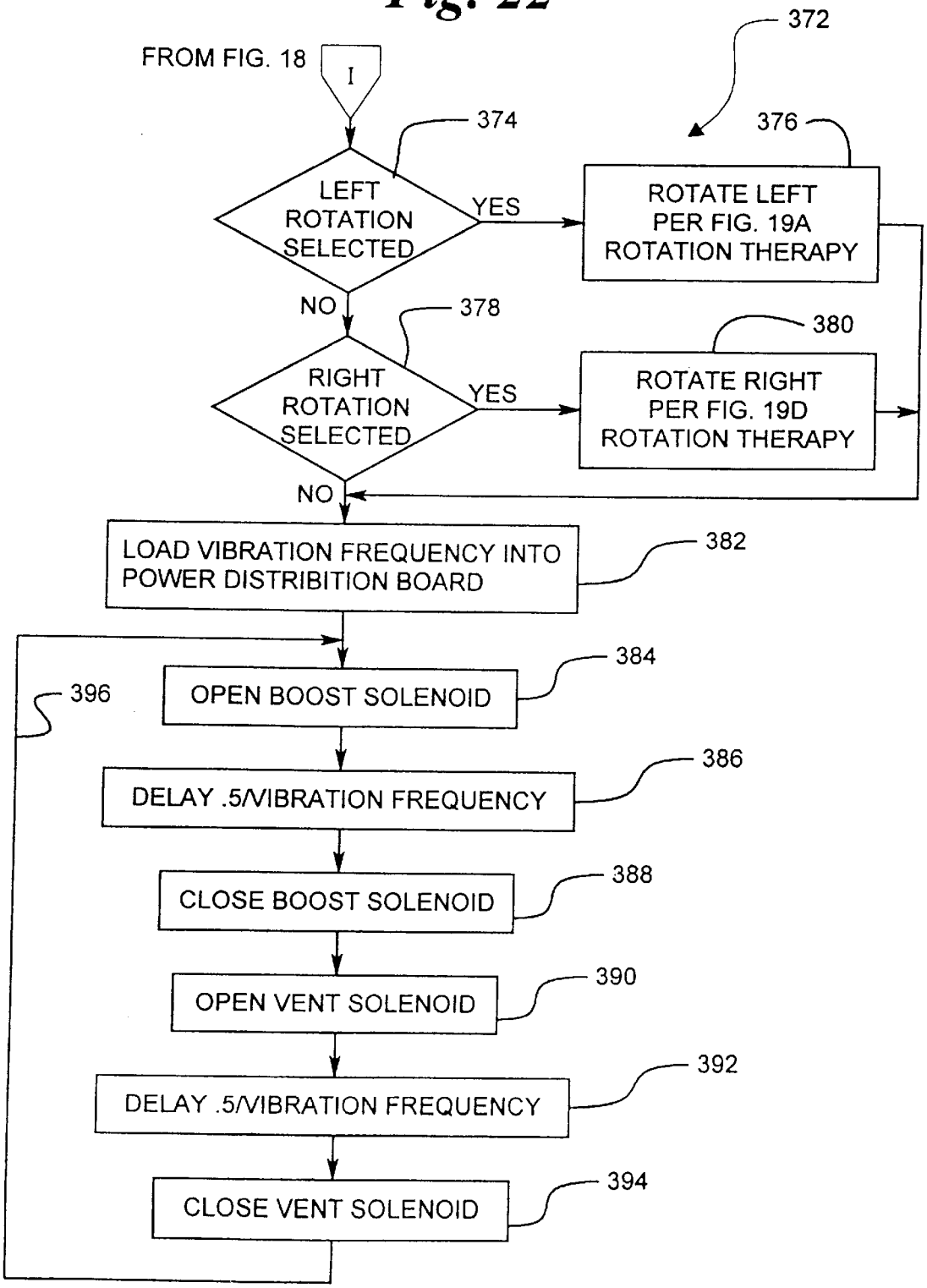
FIG. 22 depicts an exemplary flowchart for implementation of vibration therapy for a bed in accordance with the present invention.

Referring now to FIG. 22, therein is depicted a flowchart for an exemplary routine 372 for implementation of vibration therapy. Vibration therapy is essentially identical to percussion therapy, with the exception that the percussion will operate at approximately 1–5 cycles per second; while vibration will cycle at approximately 6–25 cycles per second. In the vibration therapy routine 372, determination is first made as to whether left rotation was selected 374. As with percussion, if left rotation was selected, then the patient is rotated to the left 376 in accordance with the flowchart of FIG. 18A. Alternatively, if it is determined that right rotation was selected 378, then the patient is rotated to the right 380 in accordance with FIG. 16C. Alternatively, of course, the patient may be merely retained in a horizontal position. Once the patient is in the desired position, the operator-selected vibration frequency is connected to the power distribution board for controlling valve operation 382. The boost solenoid (480 in FIG. 31) is then opened 384, and after a delay of one half of the preselected vibration frequency 386, the boost solenoid will be closed 388. The vent solenoid (481 in FIG. 31) will then be opened 390, and after again a delay of one half of the preselected vibration frequency 392, the vent solenoid will be closed 394. The sequence will then be repeated 396 for the desired duration of vibration therapy.

Figure 23:
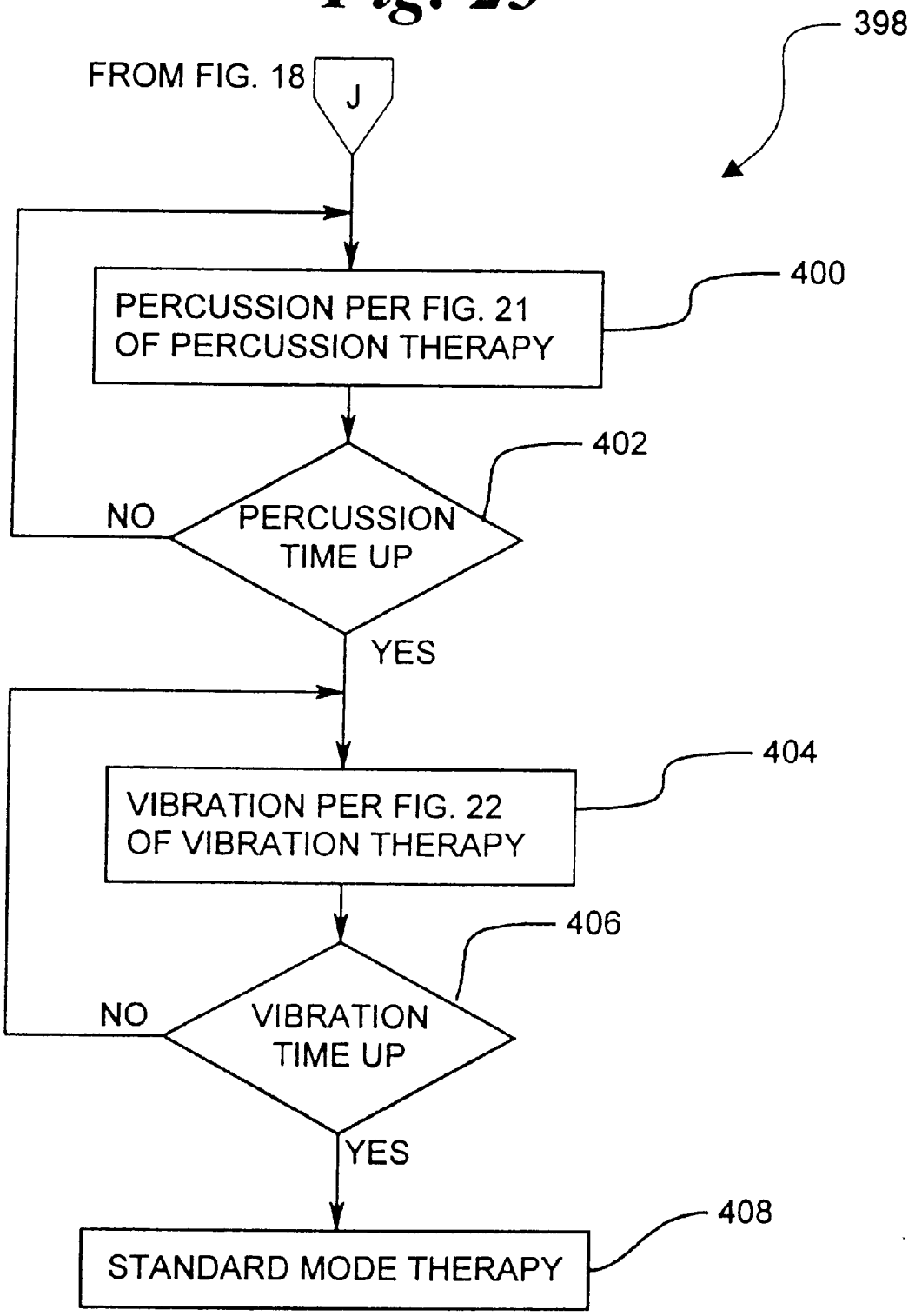
FIG. 23 depicts an exemplary flowchart for implementation of combination percussion and vibration therapy for a bed in accordance with the present invention.

Referring now to FIG. 23, therein is depicted a flowchart for combination percussion/vibration therapy 398. If the combination percussion/vibration therapy mode is selected, then percussion therapy will be instituted in accordance with percussion routine 346 of FIG. 20. At such time as the preestablished percussion duration has elapsed 402, then vibration therapy will be instituted 404, in accordance with flowchart 372 of FIG. 21. Once the predetermined vibration therapy period has elapsed 406 then the patient will be returned to standard mode therapy 408.

Figure 25:
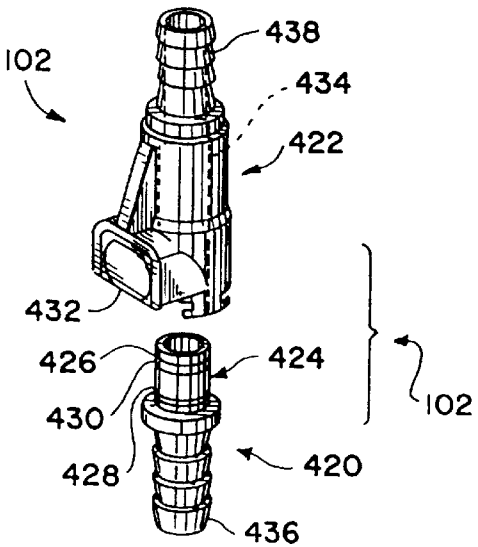
FIG. 25 depicts an exemplary connector suitable for use in connecting tubing or other members to supply air between the support plate assembly and the overlay assembly of FIG. 11.

Referring now to FIG. 25, therein is depicted an exemplary embodiment of a manual release connector 102, as is described earlier herein, as being particularly useful for providing connections wherein hoses are to be coupled. Connector 102 includes a male member 420 and a female member assembly 422. Male member 420 includes an extending portion 424 which includes two circumferential grooves 426, 428. Longitudinally outermost circumferential groove 426 houses an O-ring 430 by which to assure a sealing engagement with a complementary bore 434 within female member 422. Second circumferential groove 428 is designed to align with a retaining plate 432 forming a portion of female member assembly 422. Retaining plate 432 includes an elliptical aperture proximate an entrance to interior bore 434 of female member 422. Retaining plate 432 is resiliently loaded, such as by a spring (not illustrated), such that in an unactuated condition, retaining plate 432 extends partially across the opening to internal bore 434. When male member 420 is operably coupled to female member 422, retaining plate will at such time engage circumferential groove 428 on male member 422 and thereby retain the two members in interlocked and operative relation to one another. Subsequent movement of retaining plate 432 will move plate 432 out of engagement with groove 428 and allow release of male member 420 from female member 422. In most applications, male member 420 and female member assembly 422 will each include fluted connecters 436, 438, respectively, to facilitate coupling of hoses or similar apparatus to each member.

Figures 28A, 28B, 28C:
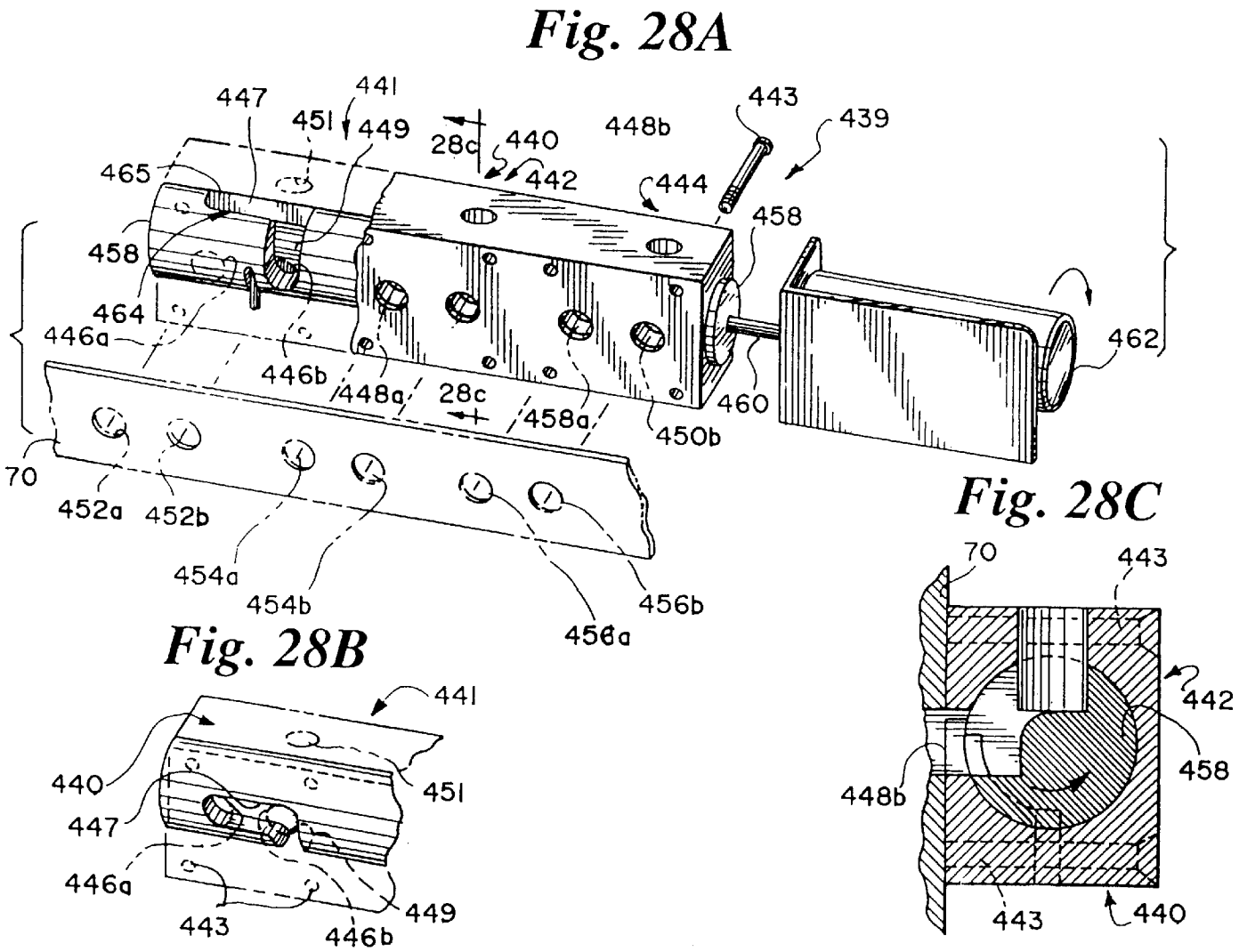
FIGS. 28A–C depict an exemplary seat dump valve useful with the present invention.

Referring now to FIGS. 28A–C, therein is depicted an exemplary embodiment of a dump valve 439 appropriate for use with the present invention. As previously discussed, the purpose of dump valve 439 is to evacuate air from the seat section working cushion group 80 to facilitate patient ingress and egress. Dump valve 439 includes a valve block 440, having three axially aligned valve sections 441, 442, 444, which is operatively coupled, such as by bolts to support plate section 70. Coupling of valve block 440 to support section 70 brings pairs of valve apertures 446*a, b*; 448*a, b*; and 450*a, b* into registry with corresponding apertures 452*a, b*; 454*a, b*; and 456*a, b*, respectively, in support section 70. A rotating valve member 458 is operatively coupled, such as through shaft 460 and a slip clutch to an electric motor 462, configured to selectively initiate rotation of valve member 458 in response to control panel 36 or another switch mechanism. Rotation of valve member 458 is approximately 90 degrees relative to valve blocks 440, 442, and 444. Rotating valve member 458 includes three generally L-shaped passages (one depicted at 464 in FIG. 28A) which are spaced such that in a first position (see FIG. 28B) one leg 447 of the L-shaped profile interconnects pairs of apertures (for example 446*a* and *b;* while in a second position (see FIG. 28A), the other leg 449 of the L interconnects one of the apertures (for example 446*b*), with the corresponding vent aperture for that block (see 447). Thus, when valve block 458 is in the described first position, air (for example, from outlet 452*a* in FIG. 4) will enter an aperture (e.g., 446*a*), and will be communicated directly to an outlet aperture 446*b* coupled to working cushions of seat section cushion group 80 (i.e., cushions 180) through the corresponding aperture (e.g., 452*b*) in support plate member 70. However, upon actuation of motor 462 to rotate valve member 458 to the position depicted in FIG. 28A, those working cushions (180) will be coupled (through aperture 452*b*), through segment 449 in valve member 458 to vent aperture (e.g., 451) causing deflation of the connected working cushions.

Figure 30:
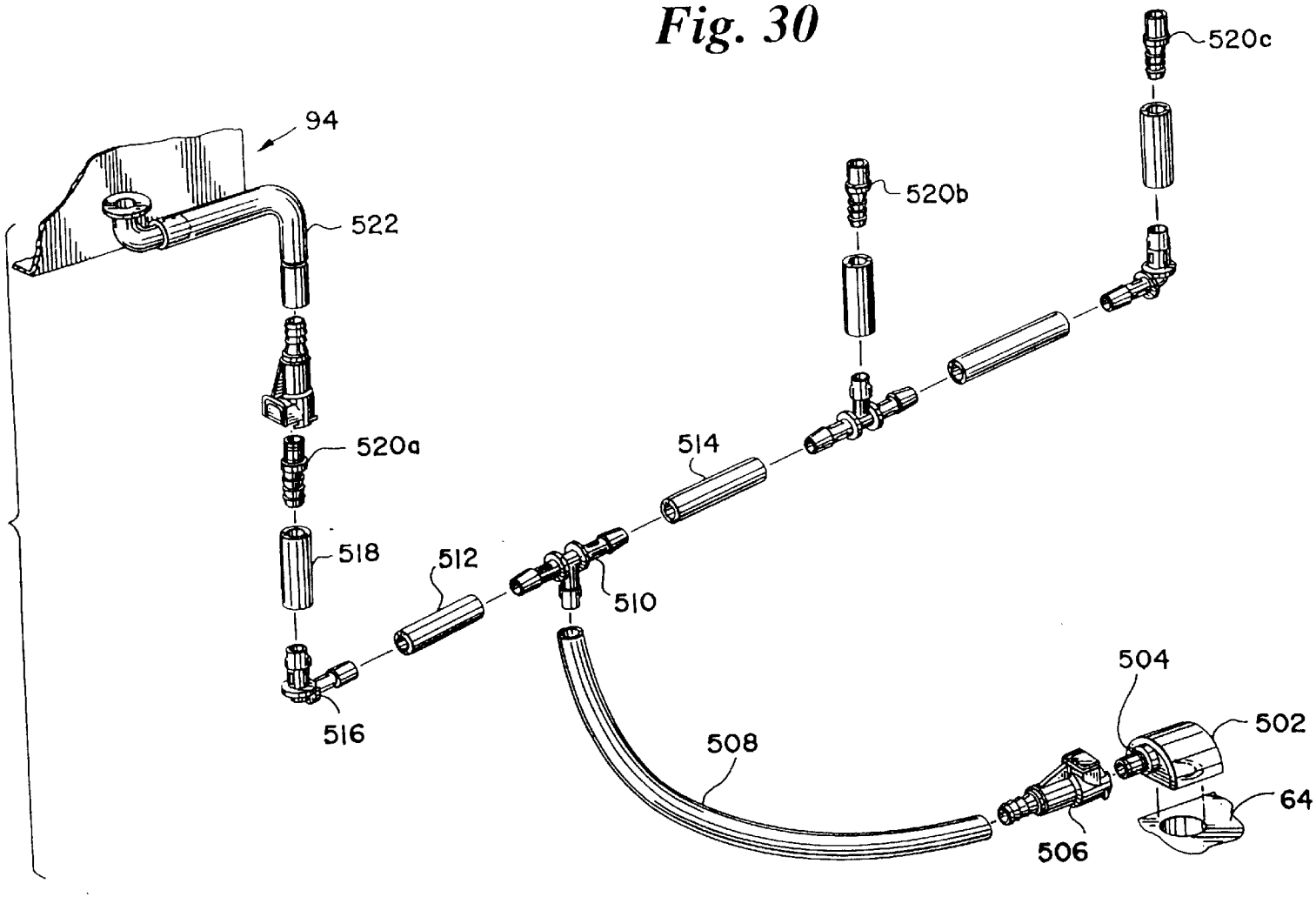
FIG. 30 depicts an exemplary assembly as may be used to supply air to cells in the overlay assembly of FIG. 11, and in particular to the foot section thereof.

Referring now to FIG. 30, therein is depicted an exemplary assembly as may be utilized to provide fluid communication between support plate assembly 64 and portions of overlay assembly 94. In particular, the depicted assembly is of a type as would be utilized to provide fluid communication between support plate assembly 64 and the bolster sections of foot cushions 157 (see FIG. 3). A dome connector 502 is preferably adhesively coupled to support plate assembly 64. A connector member 504 is threadably coupled to dome connector 502. Connector member 504 may be fitting as manufactured by Colter Products Company of St. Paul, Minn., and identified as Part No. PLC240-04. A complimentary connector 506, such as CPC fitting model PLDC170-06 (see FIG. 25) will then be utilized to provide fluid communication through a length of appropriate tubing 508 to a T fitting 510. Lengths of tubing 512 and 514 will then be utilized to provide further fluid communication. Specifically, tubing 512 will be connected through an elbow fitting 516 (such as CPC model PLCD230-06) and through another length of tubing 518 to a releasable coupling 520*a*. This releasable coupling may form an assembly, such as is depicted in FIG. 25, which will be connected to either through a length of tubing (522, as depicted) or directly to an appropriate cell or chamber in overlay assembly 94. Similar connections will be provided for each fitting 520*a–c*. Each tubing/fitting coupling may be secured through use of a clamp, such as a conventional hose clamp. When such a clamp is utilized, it is preferred that the clamp be covered with a protective material, such as shrink-tubing or another wrap material, to protect the surfaces of adjacent inflatable cells.

Figure 32:
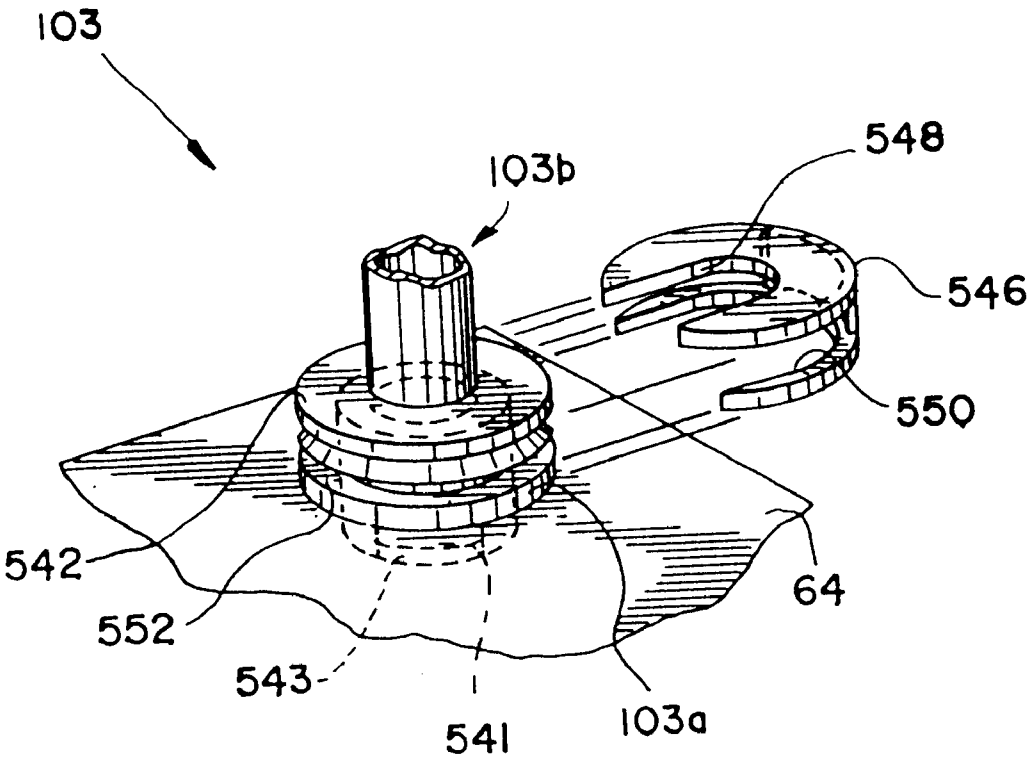
FIG. 32 depicts a clip-retained connector as may be utilized to establish fluid communication between the outermost cushions and the support surface of FIG. 3.

Referring now to FIG. 32, therein is depicted an assembly 103 as is utilized to secure the outermost working cushions of each cushion group 78, 80, and 82 to support surface 64, and to provide fluid communication to each cushion. Each cushion includes a fitting 103*b* having a circumferential retaining disc 542 extending therefrom. The lower end 541 of the fitting 103*b* will fit into a receiving bore 543 in a receptacle 103*a* adhesively secured to support plate assembly 64. A retaining clip 546, having generally C-shaped engagement apertures 548 and 550 will then be utilized to engage a circumferential groove 552 on receptacle 103*a* and circumferential disc 542 on fitting 103*b* to retain the two pieces in engaged relation.

As is apparent from the disclosure above, the preferred embodiment facilitates the establishing of desired interface pressures, coupled with a low air loss surface, and lateral support, or cradling, through use of a multi-zoned inflatable overlay; and further facilitates lateral positioning of the patient through use of a lower level of inflatable cells. Many modifications and variations may be made in the techniques and structures described and illustrated herein without departing from the spirit and scope of the present invention. For example, the lower inflatable level may be formed of one or more multi-celled units. Similarly, additional zones may be defined in either the upper or lower inflatable levels to achieve such degree of control as may be desired. Additionally, the lower inflatable level itself has utility for supporting a patient directly, without the intervening upper inflatable support layer (in which case portions of the lower inflatable layer may provide for air flow, as desired). Accordingly, it should be readily understood that the structures and methods described and illustrated herein are illustrative only, and are not to be considered as limitations upon the scope of the present invention.

What is claimed is:

1. A bed comprising:

a bed frame;

a support plate assembly mounted to said bed frame, said support plate assembly includes a plurality of plate sections wherein at least three sections are connected such that two generally transverse articulation points are formed to facilitate articulation of said plates;

a first pair of longitudinally extending, controllably inflatable air bags coupled to said plate assembly, said first longitudinal pair of bags laterally offset from one another and extending generally parallel along a first portion of the longitudinal length of said support plate assembly, one of said longitudinally extending bags is controllably inflatable generally independently of the other longitudinally extending bag of said first pair;

a second pair of longitudinally extending, controllably inflatable air bags coupled to said support plate assembly, said second longitudinal pair of bags laterally offset from one another and extending generally parallel and longitudinally offset from said first pair of longitudinal bags along a second portion of the longitudinal length of said support plate assembly, one of said second pair of longitudinally extending bags is controllably inflatable generally independently of the other longitudinally extending bag of said second pair;

a support layer positioned generally above said first and second pairs of longitudinal bags, said support layer including a plurality of controllably inflatable, transverse air bags, said transverse bags being grouped into a plurality of independently controllable pressure zones; and a control assembly attached to the bed frame and operable to supply air selectively to said longitudinally extending bags and transverse bags to provide the patient at least one of a plurality of modes, said modes including a laterally rotating mode and a percussive mode.

2. The bed of claim 1, wherein said support layer includes:

a head zone for supporting the head of the patient; and at least one bolster zone extending along at least a portion of a side edge of the support layer, said bolster zone for maintaining the patient generally centered on the bed and substantially preventing patient contact with a portion of the bed frame.

3. The bed of claim 1 further including:

a percussion cell extending generally transversely across at least a portion of the width of the frame and aligned beneath the torso area of the patient, and said control assembly selectively operable to inflate and deflate said percussion cell whereby the percussion mode is provided to the patient.

4. The bed of claim 1 wherein at least a portion of the transverse air bags of the support layer are low air loss air bags.

5. A therapeutic bed for supporting a patient, comprising:

a bed frame assembly;

a support surface assembly mounted to said bed frame assembly, said support surface assembly includes a plurality of plate sections, wherein at least three sections are connected such that two generally transverse articulation points are formed to facilitate articulation of said plates;

a first pair of longitudinally extending inflatable air bags coupled to said support surface assembly, said longitudinal air bags of the first pair laterally offset from one another and extending generally parallel along a first portion of the longitudinal length of said support surface assembly, each longitudinally extending air bag being alternatively inflated of the other longitudinally extending air bag to lift a portion of the patient to laterally rotate the patient;

a second pair of longitudinally extending inflatable air bags coupled to said support surface assembly, said second pair of longitudinal air bags laterally offset from one another and extending generally parallel and longitudinally offset from said first pair of longitudinal air bags along a second portion of the longitudinal length of said support surface assembly, each longitudinally extending air bag of said second pair of air bags being alternatively inflated of the other longitudinally extending air bag of the second pair to lift a portion of the patient to laterally rotate the patient;

an inflatable upper layer positioned above at least a portion of said first and second pairs of longitudinal air bags, said upper layer including a plurality of generally transversely extending air bags, at least some of said transverse bags are inflatable independently of others of said transverse air bags of said inflatable upper layer, said upper layer further including a plurality of separately inflatable zones formed from at least a portion of the air bags of the upper layer;

a percussion cell assembly extending generally transversely across at least a portion of the width of the bed and aligned beneath the torso area of the patient, said percussion cell assembly being adapted to be selectively inflated and deflated to provide a percussion mode; and a programmable electronic controller assembly mounted to said bed frame assembly and selectively operable to control the pressure in said longitudinal air bags, said zones of the upper layer and said percussion cell assembly whereby the patient may be provided a plurality of operating modes.

* * * * *